US009070320B2

(12) United States Patent
Song et al.

(10) Patent No.: US 9,070,320 B2
(45) Date of Patent: Jun. 30, 2015

(54) DISPLAY DEVICE AND DRIVING METHOD FOR THE SAME

(75) Inventors: Myoung-Seop Song, Yongin (KR); An-Su Lee, Yongin (KR); Do-Youb Kim, Yongin (KR); Seung-Woo Lee, Yongin (KR); Myung-Ho Lee, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 345 days.

(21) Appl. No.: 13/604,508

(22) Filed: Sep. 5, 2012

(65) Prior Publication Data

US 2013/0207940 A1 Aug. 15, 2013

(30) Foreign Application Priority Data

Feb. 10, 2012 (KR) ..... 10-2012-0013898

(51) Int. Cl.
*G09G 3/36* (2006.01)
*G09G 3/20* (2006.01)
*G09G 3/32* (2006.01)

(52) U.S. Cl.
CPC ..... *G09G 3/20* (2013.01); *G09G 3/2025* (2013.01); *G09G 3/3233* (2013.01); *G09G 2300/0452* (2013.01); *G09G 2300/0804* (2013.01); *G09G 2300/0814* (2013.01); *G09G 2300/0842* (2013.01); *G09G 2300/0861* (2013.01); *G09G 2310/0218* (2013.01)

(58) Field of Classification Search
CPC ..... G06F 3/038; G09G 3/03; G09G 3/034; G09G 3/036; G02F 1/133
USPC ..... 345/76–87, 204, 690, 691, 694, 69; 348/608
See application file for complete search history.

(56) References Cited

U.S. PATENT DOCUMENTS

2010/0149151 A1* 6/2010 Nam et al. ..... 345/211
2011/0292099 A1* 12/2011 Kim et al. ..... 345/691

FOREIGN PATENT DOCUMENTS

JP 2008-116689 A 5/2008
JP 2010-250193 A 11/2010
KR 10-2000-0026581 A 5/2000
KR 10-2006-0017201 A 2/2006
KR 10-2006-0065084 A 6/2006
KR 10-2009-0129248 A 12/2009

* cited by examiner

*Primary Examiner* — Kent Chang
*Assistant Examiner* — Mark Edwards
(74) *Attorney, Agent, or Firm* — Knobbe Martens Olson & Bear LLP

(57) ABSTRACT

A display device is disclosed. In one aspect, the display device includes a display panel for displaying an image in at least two separate fields during a frame, a panel driver configured to transmit output data for each field corresponding to the at least two fields and drive the display panel according to each field, and a controller configured to analyze an image pattern corresponding to input data, and generate the output data for each field from the input data according to an analysis result of the pattern, or extract each field data from the input data according to a predetermined data alignment method and generate the output data for each field by using the field data.

29 Claims, 25 Drawing Sheets

FIG.12

Data1

| | | | | | | | | | | | | |
|---|---|---|---|---|---|---|---|---|---|---|---|---|
| L1 | R11 | G11 | B11 | R12 | G12 | B12 | R13 | G13 | B13 | R14 | G14 | B14 |
| L2 | R21 | G21 | B21 | R22 | G22 | B22 | R23 | G23 | B23 | R24 | G24 | B24 |
| L3 | R31 | G31 | B31 | R32 | G32 | B32 | R33 | G33 | B33 | R34 | G34 | B34 |
| L4 | R41 | G41 | B41 | R42 | G42 | B42 | R43 | G43 | B43 | R44 | G44 | B44 |

FIG. 13A

Data1-1(B)

| | | | | | | | | | |
|---|---|---|---|---|---|---|---|---|---|
| L1 | R11 | Black | B11 | Black | G12 | Black | R13 | Black | B13 | Black | G14 | Black |
| L2 | R21 | Black | B21 | Black | G22 | Black | R23 | Black | B23 | Black | G24 | Black |
| L3 | R31 | Black | B31 | Black | G32 | Black | R33 | Black | B33 | Black | G34 | Black |
| L4 | R41 | Black | B41 | Black | G42 | Black | R43 | Black | B43 | Black | G44 | Black |

First field (1SF)

FIG.13B

Data1-2(B)

| Second field (2SF) | | | | | | | | | | | | |
|---|---|---|---|---|---|---|---|---|---|---|---|---|
| L1 | Black | G11 | Black | R12 | Black | B12 | Black | G13 | Black | R14 | Black | B14 |
| L2 | Black | G21 | Black | R22 | Black | B22 | Black | G23 | Black | R24 | Black | B24 |
| L3 | Black | G31 | Black | R32 | Black | B32 | Black | G33 | Black | R34 | Black | B34 |
| L4 | Black | G41 | Black | R42 | Black | B42 | Black | G43 | Black | R44 | Black | B44 |

FIG.17A

Data1-1(BF)

| | | | | | | |
|---|---|---|---|---|---|---|
| L1 | R11 | B11 | G12 | R13 | B13 | G14 |
| L2 | R21 | B21 | G22 | R23 | B23 | G24 |
| L3 | R31 | B31 | G32 | R33 | B33 | G34 |
| L4 | R41 | B41 | G42 | R43 | B43 | G44 |

First field (1SF)

FIG.17B

Data1-2(BF)

| | | | | | | |
|---|---|---|---|---|---|---|
| L1 | G11 | R12 | B12 | G13 | R14 | B14 |
| L2 | G21 | R22 | B22 | G23 | R24 | B24 |
| L3 | G31 | R32 | B32 | G33 | R34 | B34 |
| L4 | G41 | R42 | B42 | G43 | R44 | B44 |

Second field (2SF)

FIG.21A

Data1-1(NF)

First field (1SF)

| | | | | | | |
|---|---|---|---|---|---|---|
| L1 | R11 | B11 | G12 | R13 | B13 | G14 |
| L2 | G21 | R22 | B22 | G23 | R24 | B24 |
| L3 | G31 | R32 | B32 | G33 | R34 | B34 |
| L4 | R41 | B41 | G42 | R43 | B43 | G44 |

FIG.21B

Data1-2(NF)

Second field (2SF)

| | | | | | | |
|---|---|---|---|---|---|---|
| L1 | G11 | R12 | B12 | G13 | R14 | B14 |
| L2 | R21 | B21 | G22 | R23 | B23 | G24 |
| L3 | R31 | B31 | G32 | R33 | B33 | G34 |
| L4 | G41 | R42 | B42 | G43 | R44 | B44 |

DISPLAY DEVICE AND DRIVING METHOD FOR THE SAME

CROSS-REFERENCE TO RELATED APPLICATION

This application claims priority to and the benefit of Korean Patent Application No. 10-2012-0013898 filed in the Korean Intellectual Property Office on Feb. 10, 2012, the entire contents of which are incorporated herein by reference.

BACKGROUND

1. Field

The disclosed technology generally relates to a display device and a driving method for the same, and more particularly, to a display device which is configured to write data to the display using a time-division driving scheme and a driving method for the same.

2. Description of Related Technology

In a time-division driving scheme, the pixels of a display device are grouped into at least two groups and the period of one frame is divided into at least two fields, thereby writing data to the pixels of a group corresponding to each field in order to emit light.

A display device employing a time-division driving scheme displays an image of a frame in at least two separate images, so that input data representing an image of a frame (hereinafter, one frame input data) is divided into fields (or pixel groups) and aligned in a memory.

However, a specific image may act as a disruptive pattern which interferes with an image that is written to the time-division driven display device based on how the pixels are grouped. The disruptive pattern refers to a display pattern which causes picture distortion when an image is displayed on a display device according to a time division driving method. Examples of picture distortion include pseudo contour, false contour, color separation, or the like.

The above information disclosed in this Background section is only for enhancement of understanding of the background of the invention and therefore it may contain information that does not form the prior art that is already known to a person of ordinary skill in the art.

SUMMARY OF CERTAIN INVENTIVE ASPECTS

The disclosed embodiments describe systems and methods to reduce picture distortion in a display device.

According to one aspect, a display device is disclosed. The display device includes a display panel for displaying configured to display an image in at least two separate fields during a frame, a panel driver configured to transmit output data for each field corresponding to the at least two fields to the display panel and drive the display panel according to each field, and a controller. The controller is configured to receive input data, and analyze an image pattern corresponding to the input data to generate the output data for each field based on the input data according to the analysis result of the pattern, or generate the output data for each field by using data for each field extracted from the input data according to a predetermined data alignment method.

A method for driving a display device is disclosed. According to one aspect, the display device includes frame that is driven in a first field and a second field based on input data to be transmitted to the display panel in the first field and the second field, respectively, and an image is displayed for each field. The method includes analyzing an image pattern of the input data to generate an analysis result of the pattern, determining if the pattern is a normal pattern or an abnormal pattern based on the analysis result, if the pattern is a normal pattern, generating output data for each field from the input data to be transmitted to the first field and the second field, respectively. If the pattern is an abnormal pattern, the method includes extracting data for each field from the input data in accordance with a predetermined data alignment method and generating output data for each field to be transmitted to the first field and the second field, respectively, by using the data for each field.

BRIEF DESCRIPTION OF THE DRAWINGS

FIG. 12 is a view showing a map of input data of a display device according to some embodiments.

FIG. 13A and FIG. 13B are views showing data maps for respective fields in accordance with a data alignment method in the time-division driving of a display device according to some embodiments.

FIG. 17*a* and FIG. 17*b* show data maps for respective fields in accordance with the second alignment method among the data alignment methods.

FIG. 21A and FIG. 21B show data maps for respective fields in accordance with a data alignment method according to some embodiments.

DETAILED DESCRIPTION OF CERTAIN INVENTIVE EMBODIMENTS

Figure 1:
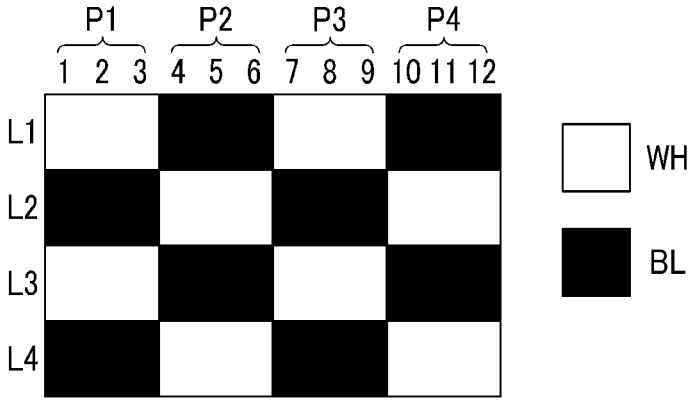
FIG. 1 shows an example of a 1-dot pattern structure in pixel units.

In the following detailed description, only certain embodiments of the present invention have been shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Images displayed on a display panel of a display device are various in shape depending on data signals (hereinafter, input data) input from the outside. One of various display patterns of display images on the display panel may be a 1×1 dot pattern (hereinafter, 1-dot pattern). FIG. 1 shows an example of a 1-dot pattern structure in pixel units. However, the 1-dot pattern is not necessarily limited to a repeated image display of colors shown in FIG. 1.

The 1-dot pattern is an array of white and black squares in equal proportions alternating in vertical and lateral directions. In the 1-dot pattern, a repeating unit of full-white image and black image is defined as a dot area. Dot areas display colors vertically and laterally in turn. A dot area may be a region in which a pixel emits light, or a region in which at least one subpixel emitting light of different colors emits light. Accordingly, the number of pixels defined by a dot area is not limited.

FIG. 1 illustrates that one pixel P1, P2, P3, and P4 including three subpixels displaying red, green, and blue, respectively, is a 1-dot area. When all the three subpixels displaying red, green, and blue, respectively, in the 1-dot area of FIG. 1 emit light with maximum luminance, this 1-dot area becomes a white dot area WH for displaying white. When all the three subpixels emit light with black luminance or are not driven, this 1-dot area becomes a black dot area BL for displaying black.

Figure 2:
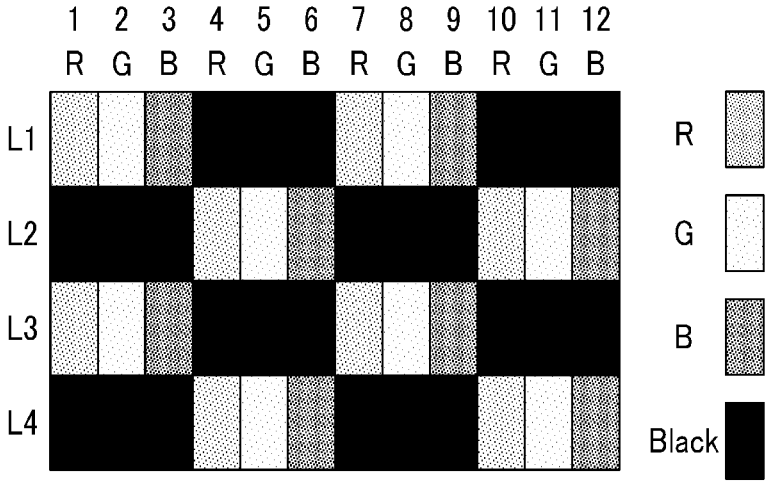
FIG. 2 is a view showing the pattern of FIG. 1 in subpixel units.

FIG. 2 is a view showing the pattern of FIG. 1 in subpixel units. FIG. 1 illustrates that a 1-dot area is a pixel including a subpixel (R) for displaying red, a subpixel (G) for displaying green, and a subpixel (B) for displaying blue. These RGB subpixels are sequentially arranged.

Accordingly, the first dot area of the first pixel line L1 of FIG. 2 includes RGB subpixels, and displays a white image when it emits light with maximum luminance. The dot area, as used herein, becomes a white dot area WH. The second dot area adjacent in the lateral direction (horizontal direction) includes RGB subpixels, and displays a black image when each subpixel is not driven or black data is input to each subpixel. The dot area, as used herein, becomes a black dot area BL. For convenience of explanation, displaying a black image encompasses the concept that a pixel does not emit light because it is not driven and the concept that black data is input and therefore an image is displayed. The RGB subpixels included in each of dot areas consecutive in the horizontal direction display a white image and a black image by repeating emission and non-emission.

Likewise, the RGB subpixels included in the dot area (first pixel of the second pixel line) vertically adjacent with respect to the first dot area (white dot area) of the first pixel line L1 do not emit light and display a black image. The RGB subpixels included in each of dot areas consecutive in the vertical direction display a white image and a black image by repeating emission and non-emission.

Figure 3A:
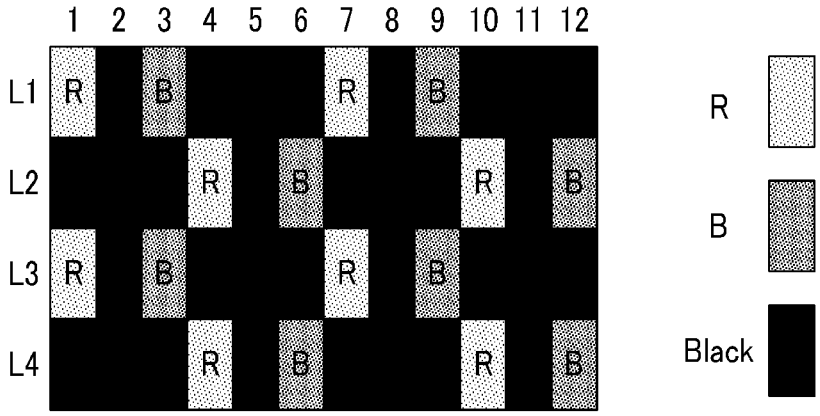
FIG. 3A and FIG. 3B are views showing light emission types of subpixels for each field of a frame in a display device employing a conventional data alignment method when the 1-dot pattern of FIGS. 1 and 2 is represented.
Figure 3B:
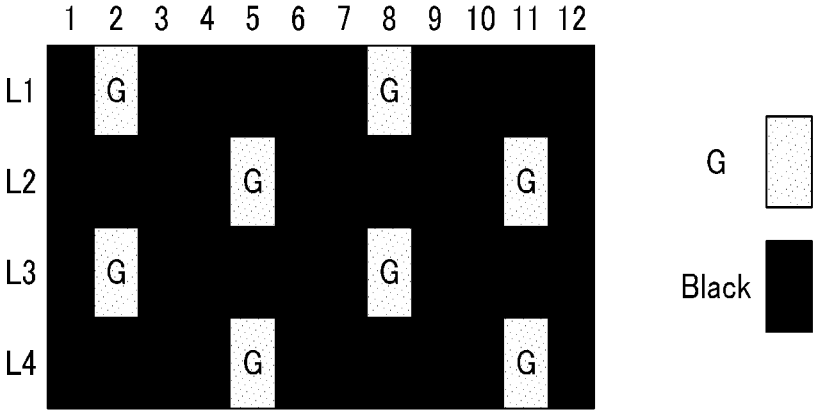

FIG. 3A and FIG. 3B are views showing light emission types of subpixels for each field of a frame in a display device employing a conventional data alignment method when the 1-dot pattern of FIGS. 1 and 2 is represented.

When data for displaying the 1-dot pattern is input as input data and an image is time-divisionally driven, FIG. 3*a* shows a light emitting pattern in the first field and FIG. 3B shows a light emitting pattern in the second field.

In FIG. 3*a*, the first field displays a pink image, which is the mixture of red and blue, by the light emission of R subpixels and B subpixels respectively included in a plurality of white dot areas. Each of a plurality of black dot areas other than the white dot areas displays a black image.

On the other hand, in FIG. 3B, the second field displays a green image by emission of light from G subpixels respectively included in the plurality of white dot areas. Each of the plurality of black dot areas displays a black image.

Accordingly, when the first field and the second field are driven by time division method, color separation occurs as shown in FIGS. 3*a* and 3B. Particularly, green having a relatively higher luminance level than red and blue is displayed separately in one field, a data image of the 1-dot pattern in one frame causes a user to feel a severe color separation. As such, when the 1-dot pattern is driven and displayed in a time division manner by a typical data alignment method, the 1-dot pattern may be a disruptive pattern.

Accordingly, in the disclosed embodiments, if part of input data includes data of the 1-dot pattern, which is a disruptive pattern, input data processing and data realignment are performed in order to prevent picture distortion on the entire display image.

Figure 4:
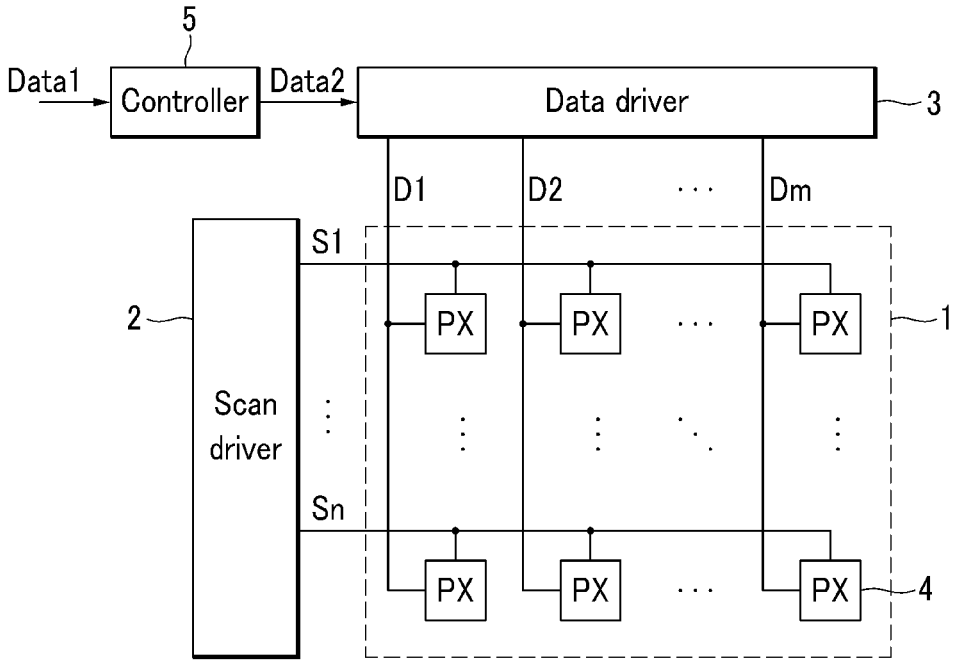
FIG. 4 is a schematic block diagram of a display device according to some embodiments.

FIG. 4 is a schematic block diagram of a display device according to some embodiments.

The display device may include a display panel 1, a scan driver 2, a data driver 3, and a controller 5.

The display panel 1 is a typical display panel including a plurality of pixels PX each having a light emitting element. Each pixel PX of the display panel 1 according to some embodiments may include a light emitting element that displays predetermined colors of red, green, and blue according to fields in time division driving method during one frame.

All of the plurality of pixels included in the display panel 1 may be grouped into pixel groups each including a plurality of pixels that emit light in a predetermined field of a frame.

Hereinafter, a time-division driving scheme according to some embodiments will be described on the assumption that a frame is divided into a first field and a second field. However, the disclosed embodiments are not limited thereto, but a frame may be divided into three or more fields.

When a frame is time-divisionally driven as two fields, a plurality of pixels of the display panel 1 may include a first pixel group including a plurality of first pixels that emit light in the first field and a second pixel group including a plurality of second pixels that emit light in the second field.

Each of the plurality of pixels of the display panel 1 is connected to a corresponding one of a plurality of scan lines S1 to Sn extending in a first direction (e.g., row direction) and a corresponding one of a plurality of data lines D1 to Dm extending in a second direction (e.g., column direction) perpendicular to the first direction. In an example, a pixel 4 is formed in a pixel region defined by the last n-th scan line Sn and the last m-th data line Dm.

Although not shown in FIG. 4, a power line for supplying driving power is connected to the plurality of pixels included in the display panel 1, and the power line is connected to a driving power supply portion.

A scan driver 2 sequentially applies scan signals to the plurality of scan lines S1 to Sn so as to write a data signal in a pixel connected to the corresponding scan line. The scan driver 2 sequentially transmits, a plurality of scan signals to all the pixels of the display panel 1 for each field according to time division driving method.

Each time scan signals are sequentially applied, the data driver 3 applies a data signal to the pixels enabled by the scan signals via a corresponding one of a plurality of data lines D1 to Dm. The data signal is a data signal corresponding to output data for each of fields rearranged by a controller 5 by a data alignment method according to some embodiments. The light emitting element of each pixel emits light by a driving current corresponding to the data signal.

The controller 5 receives input data Data1 from the outside in order to realize an image of each field by time division driving. Furthermore, output data Data2 applied to each pixel is generated for each pixel and transmitted to the data driver 3. The output data Data2 includes first field data Data1-1 to be transmitted to the first field constituting a frame and second field data Data1-2 to be transmitted to the second field.

As used herein, input data Data1 itself is used as the output data Data2 aligned for each field, or the input data Data1 is stored and then generated into the output data Data2 in accordance with the data processing and alignment method. The controller 5 receives the input data Data1 from the outside and determines whether the input data Data1 includes a disruptive pattern, and performs data processing according to the presence or absence of a disruptive pattern. A concrete data processing method of the controller 5 will be described in FIG. 5 that follows.

In addition to the data processing, the controller 5 receives a synchronization signal and a clock signal, and generates and transmits control signals for driving the display panel. The control signals include a variety of driving control signals for controlling the operations of the respective drivers except the display panel.

Figure 5:
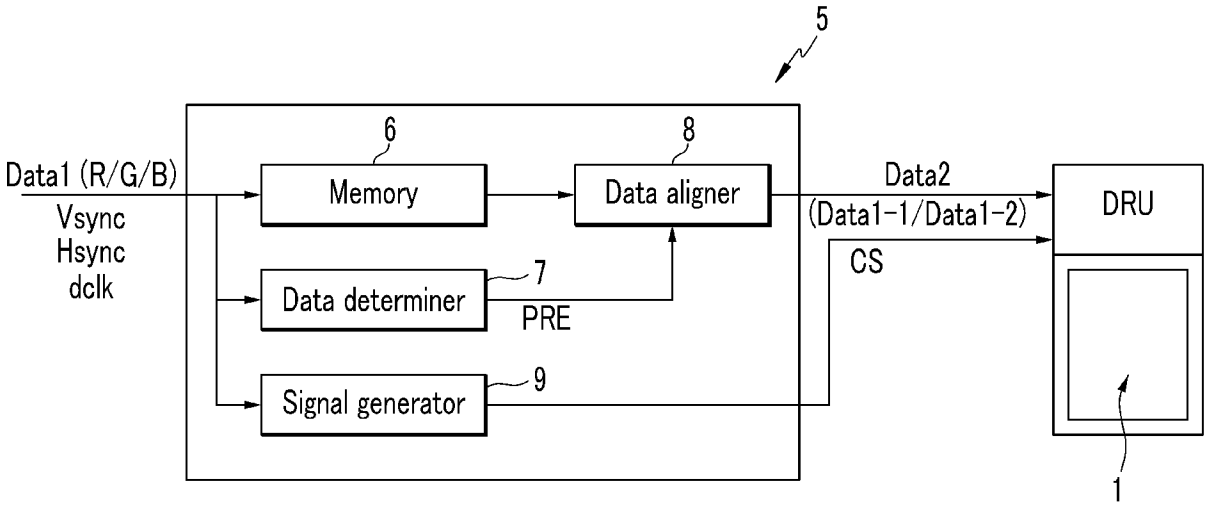
FIG. 5 is a schematic block diagram of the controller according to the embodiment of FIG. 4.

FIG. 5 is a schematic block diagram of the controller 5 according to the embodiment of FIG. 4.

Referring to FIG. 5, the controller 5 includes a memory 6, a data determiner 7, a data aligner 8, and a signal generator 9.

The controller 5 receives input data Data1 corresponding to RGB subpixels, a vertical synchronization signal Vsync, a horizontal synchronization signal Hsync, and a clock signal dclk from the outside. These signals are used in a data handling or processing process for the controller or in a generating process of a driving control signal.

The input data Data1 may be transmitted to the memory 6 and temporarily stored. According to an embodiment, the input data Data1 may be transmitted directly to the data determiner 7 and used.

The data determiner 7 analyzes image information acquired from the input data Data1, determines whether or not the input data Data1 contains a disruptive pattern such as the 1-dot pattern, and transmits information about the detection result to the data aligner 8.

There are various methods for the data determiner 7 to detect a disruptive pattern among image patterns for input data, which will be described in detail below with reference to the drawings.

If the data determiner 7 outputs a detection result PRE indicating that the input data is not a disruptive pattern but typical image data, the data aligner 8 extracts data transmitted to the first field and the second field, respectively, from the input data stored in the memory 6, and generates general time-divided output data Data2.

On the other hand, if the data determiner 7 outputs a detection result PRE indicating that the input data is a disruptive pattern, the data aligner 8 generates output data Data2 for time-division driving by a data alignment method according to some embodiments. That is, the data aligner 8 extracts part of the input data by a data arrangement method according to some embodiments, rather than by a general data arrangement method, and aligns first field data Data1-1 and second field data Data1-2. Such data as the first field data Data1-1 and the second field data Data1-2, which is generated by the controller 5 and transmitted to a driver DRU (especially, the data driver) so as to be displayed during a frame, is collectively defined as output data Data2. Among the output data transmitted to the data driver from the controller 5, the first field data Data1-1 is transmitted to a plurality of first pixels corresponding to the first field. Furthermore, the second field data Data1-2 among the output data is transmitted to a plurality of second pixels corresponding to the second field.

The arrangement method of output data generated by the data aligner 8 is not specifically limited, but may include a first method of generating output data by inserting black data between each data and a second method of generating output data by repetitively extracting different unit pattern data for each field, rather than by inserting black data. A concrete arrangement method for the first method and the second method will be described with reference to the relevant drawing.

The output data Data2 generated according to a new data arrangement method, according to some embodiments, can solve the problem of picture distortion, such as color separation and pseudo contour, on each field image even though a display image is a disruptive pattern.

Furthermore, the signal generator 9 generates and transmits a plurality of control signals CS for the driving control of each driver DRU driving the display panel 1 in the display device. The driver DRU collectively refer to driving devices for driving the pixels of the display pane, and may include a scan driver, a data driver, a light emission control driver, and a power driver. Therefore, the signal generator 9 generates and transmits driving control signals corresponding to the respective driving devices included in the driver DRU.

FIG. 6 to FIG. 10 explain an apparatus and method for detecting a disruptive pattern by the controller 5.

As mentioned above, the function of detecting a disruptive pattern may be performed by the data determiner 7 of the controller 5. That is, the input data Data1 stored or input in real time in the memory 6 is analyzed to determine if the corresponding frame image is a disruptive pattern.

Figure 6:
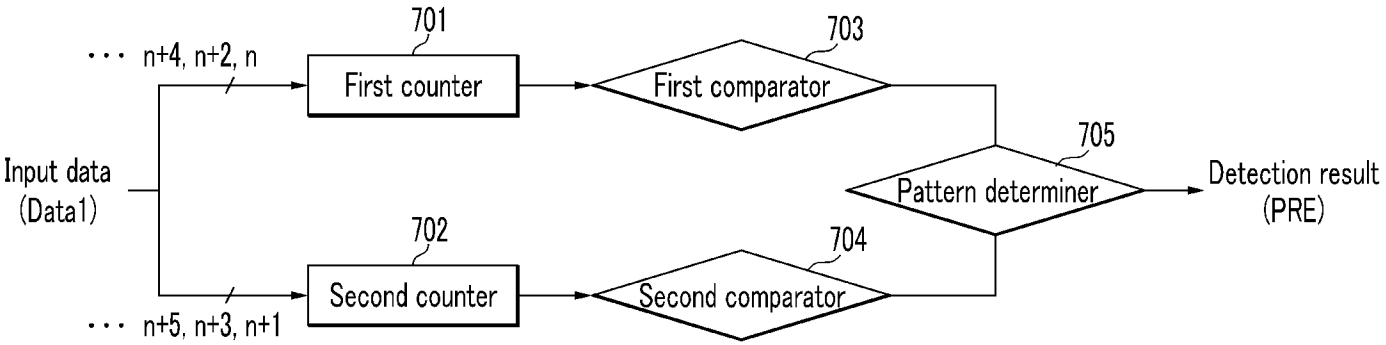
FIG. 6, FIG. 8, and FIG. 9 are schematic block diagrams of the data determiner of FIG. 5 according to some embodiments.

FIG. 6 shows a block diagram of the data determiner 7 according to some embodiments. That is, the data determiner 7-1 of FIG. 6 includes means that performs a first detection method to detect a disruptive pattern without any memory for detecting a disruptive pattern as an example of a disruptive pattern detection method.

According to the first detection method, input data of n line is sequentially read to count unit disruptive patterns, and a first flag bit is set corresponding to the first input data among the input data of n line. A unit disruptive pattern refers to a basic pattern constituting a disruptive pattern.

Next, input data of (n+1) line is sequentially read to count unit disruptive patterns, and a second flag bit is set corresponding to the first input data among the input data of (n+1) line.

If the count of unit disruptive patterns of n line is equal to a first threshold value or more, and the count of unit disruptive patterns of (n+1) line is equal to the first threshold value or more, comparison results between the first flag bit and the second flag bit are counted.

The first threshold value may be a number of times a unit disruptive pattern is repeated in one direction of the display panel, or may be set at the user's option or automatically set in accordance with the specification of the display device.

As the comparison results of the first flag bit and the second flag bit, the first flag bit and the second flag bit may be different, or may be the same. The comparison results are determined according to a disruptive pattern.

After continuously repeating this operation, if the count of comparison results between the first flag bit and the second flag bit is equal to a second threshold value or more, the corresponding frame is determined as including a disruptive pattern.

The second threshold value may be a number of times a unit disruptive pattern is repeated in a direction different from the direction of the display panel, or may be the number of data lines having repeated unit disruptive patterns according to some embodiments. Likewise, the second threshold value may be set at the user's option, or may be automatically set in accordance with the specification of the display device.

As shown in FIG. 6, the data determiner 7-1 includes a first counter 701, a second counter 702, a first comparator 703, a second comparator 704, and a pattern determiner 705.

The first counter 701 sequentially reads input data of the n-th line and counts unit disruptive patterns. The first comparator 703 determines whether or not the count of comparison results of the first counter 701 is equal to the first threshold value or more, and if the count is equal to the first threshold value or more, sets the first flag bit in accordance with the first input data of the n-th line. Herein, n may be an odd number even number.

The second counter 702 sequentially reads input data of the (n+1)-th line and counts unit disruptive patterns. The second comparator 704 determines whether or not the count of the second counter 701 is equal to the first threshold value or more, and if the count is equal to the first threshold value or more, sets the second flag bit in accordance with the first input data of the (n+1)-th line.

The pattern determiner 705 compares the first flag bit and the second flag bit, and counts comparison results indicating that the two flag bits are different (or the same).

Next, the (n+2)-th line and the (n+3)-th line are input into the first counter 701 and the second counter 702, respectively, and the same operation continues. At this point, the pattern determiner 705 counts a result that the first flag bit of the (n+2)-th line and the second flag bit of the (n+1)-th line are different, and then counts a result that the first flag bit of the (n+2)-th line and the second flag bit of the (n+3)-th line are different (or identical).

If the count of comparison results between the first flag bit and the second flag bit through the above consecutive process is equal to the second threshold value or more, the pattern determiner 705 determines that the corresponding frame of input data includes a disruptive pattern.

To help the understanding of the first detection method, the 1-dot pattern is assumed to be one of disruptive patterns. A unit disruptive pattern, as used herein, may be two pixels including a consecutive array of a black pixel (or white pixel) and a white pixel (or black pixel).

As the unit disruptive pattern is two pixels including a consecutive array of a black pixel and a white pixel, the count results of the first counter 701 and the second counter 702 increase when consecutively input data alternately represents black or white.

Moreover, if input data representing the first pixel of a corresponding line is black, the first flag bit is set to 1, and otherwise, if it is white, the first flag bit is set to 0. The pattern determiner 705 counts a result that the first flag bit and the second flag bit are different.

Figure 7:
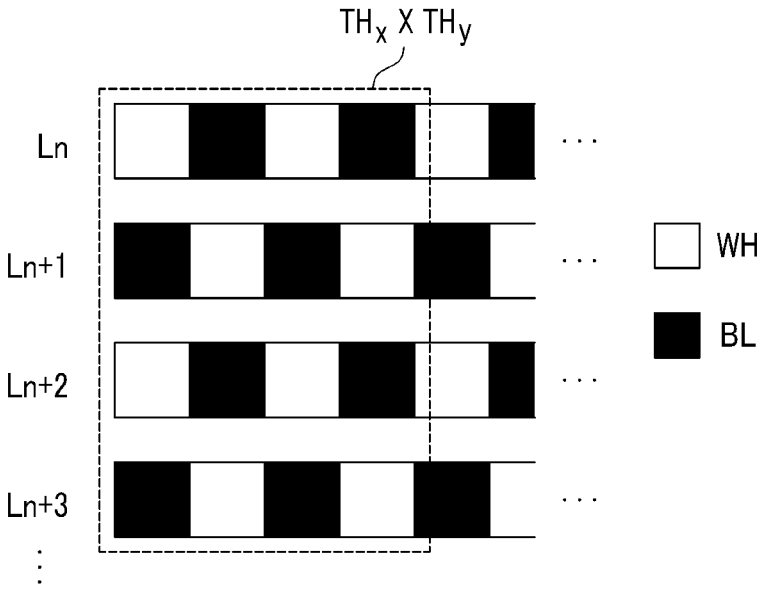
FIG. 7 is an illustration showing a threshold value of a unit disruptive pattern which is a criterion for detecting a disruptive pattern of the data determiner of FIGS. 6 to 8.

FIG. 7 is a view showing the n-th to (n+3)-th lines Ln to Ln+3 of the 1-dot pattern to explain an some embodiments. FIG. 7 indicates a threshold value of a unit disruptive pattern which is a criterion for detecting a disruptive pattern.

The first counter 701 sequentially reads input data of n line Ln, and compares consecutive input data and counts comparison results. As shown in FIG. 7, black pixels and white pixels are alternately repeated, and the count of the first counter 701 is greater than the first threshold value THx. The first flag bit is set to 0.

If the first flag bit and the second flag bit of (n−1) line Ln−1 (not shown) are different, the pattern determiner 705 may add 1 to the count of comparison results about the flag bits from 1 line to (n−1) line. However, FIG. 7 assumes that the count of comparison results between the flag bits of n lines by the pattern determiner is less than the second threshold value THy.

Next, the second counter 702 sequentially reads input data of (n+1) line Ln+1, and compares consecutive input data and counts comparison results. As shown in FIG. 7, black pixels and white pixels are alternately repeated, and the count of the second counter 702 is greater than the first threshold value THx. The second flag bit is set to 1.

As the first flag bit and the second flag bit are different, the pattern determiner 705 adds 1 to the count of comparison results between the flag bits of n lines.

Next, the first counter 701 sequentially reads input data of (n+2) line Ln+2, and compares consecutive input data and counts comparison results. As shown in FIG. 7, black pixels and white pixels are alternately repeated, and the count of the first counter 701 is greater than the first threshold value THx. The first flag bit is set to 0.

As the first flag bit and the second flag bit are different, the pattern determiner 705 adds 1 to the count of comparison results between the flag bits of (n+1) lines.

Next, the second counter 702 sequentially reads input data of (n+3) line Ln+3, and compares consecutive input data and counts comparison results. As shown in FIG. 7, black pixels and white pixels are alternately repeated, and the count of the second counter 702 is greater than the first threshold value THx. The second flag bit is set to 1.

As the first flag bit and the second flag bit are different, the pattern determiner 705 adds 1 to the count of comparison results between the flag bits of (n+2) lines. At this point, it is assumed the count of the pattern determiner 705 reaches the second threshold value THy.

Then, the pattern determiner 705 compares the count of comparison results between flag bits with the second threshold value THy, and determines that the corresponding frame includes a disruptive pattern according to the comparison results.

The pattern determiner 705 outputs a result indicating the presence of a disruptive pattern as a detection result PRE.

One of the disruptive pattern detection methods according to some embodiments may include a second detection method for detecting a disruptive pattern by using a line memory.

According to the second detection method, input data of the n-th line is sequentially read, and detection bit data is written in the corresponding address of a first line memory in accordance with a result of determination whether or not the input data has a disruptive pattern.

All detection bit data stored in the first line memory is counted, and if the count is greater than a third threshold value, the third flag bit is set to a specific bit.

Input data of the (n+1)-th line is sequentially read, and detection bit data is written in the corresponding address of a second line memory in accordance with a result of determination whether or not the input data has a disruptive pattern.

All detection bit data stored in the second line memory is counted, and if the count is greater than the third threshold value, the fourth flag bit is set to a specific bit.

If both the third flag bit and the fourth flag bit are a specific bit, the detection bit data stored in the corresponding addresses of the first and second line memories are compared with each other to determine whether or not there is a unit disruptive pattern. A unit disruptive pattern in the second detection method is set in units of two lines.

Unit disruptive patterns are counted, and if the count is equal to a fourth threshold value or more, it is determined that there is a disruptive pattern.

Figure 8:
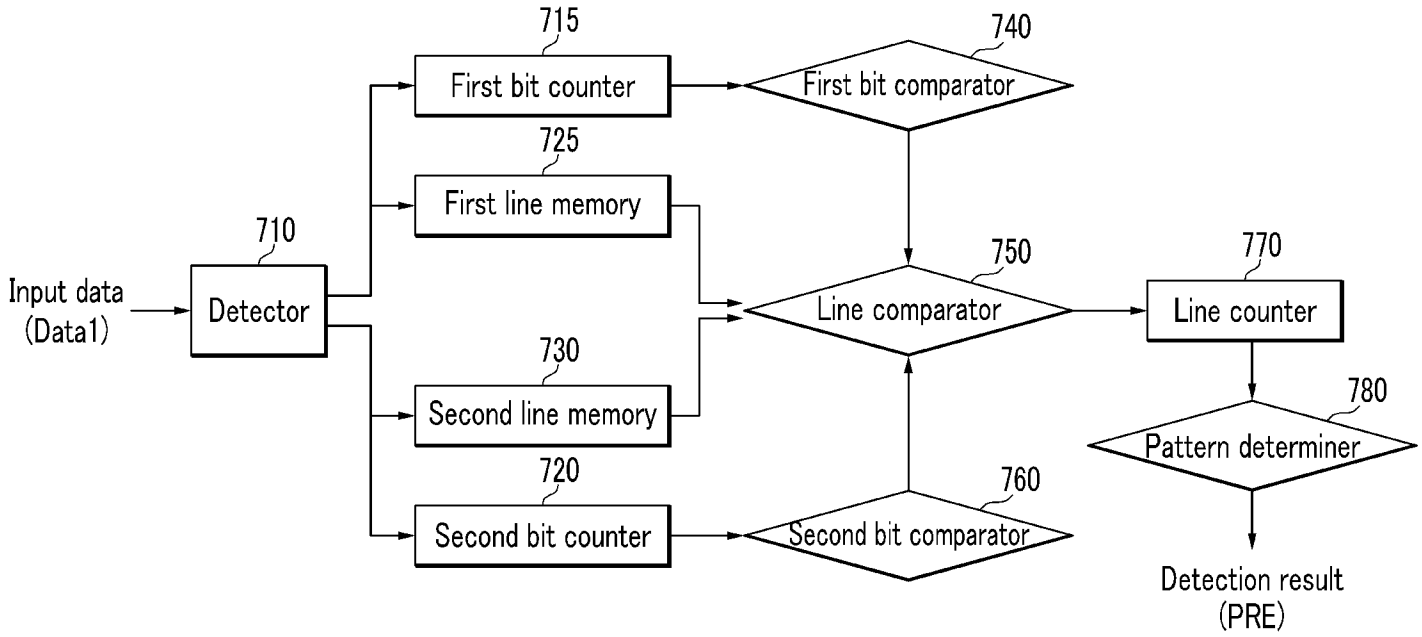

FIG. 8 shows a block diagram of the data determiner 7 according to some embodiments. That is, the data determiner 7-2 of FIG. 8 includes means that performs a second detection method to detect a disruptive pattern by using a line memory.

As shown in FIG. 8, the data determiner 7-2 includes a detector 710, a first bit counter 715, a second bit counter 720, a first line memory 725, a second line memory 730, a first bit comparator 740, a line comparator 750, a second bit comparator 760, a line counter 770, and a pattern determiner 780.

The detector 710 reads input data line by line, and detects color information of the input data for each line. Furthermore, detection bit data corresponding to the detection result is written in an address corresponding to input data read by a corresponding one among the first line memory 725 and the second line memory 730.

Detection bit data of input data is stored in the first line memory 725 in the order of n line, (n+2) line, . . . etc., and detection bit data of input data may be stored in the second line memory 730 in the order of (n+1) line, (n+3) line, . . . etc.

The corresponding line memory refers to a line memory that writes a determination result of a line (hereinafter, corresponding line) to which read input data belongs, and the corresponding address refers to the position of read input data in a line consisting of input data.

For example, if the input data is a 1-dot pattern, the detector 210 determines that input data displayed in white or black is input data constituting a disruptive pattern, and writes detection bit data '11' in a corresponding address of a corresponding line memory if input data is displayed in white, writes detection bit data '10' in a corresponding address of a corresponding line memory if input data is displayed in black, and writes detection bit data '00' in a corresponding address of a corresponding line memory if input data is displayed in neither white nor black.

The first bit counter 715 sequentially reads input data of the n-th line stored in the first line memory 725, and counts number of cases that black detection bit data 10 and white detection bit data 11 are alternately stored. The first bit comparator 740 compares the count of the first bit counter 715 with the third threshold value THx, and if the count is greater than the third threshold value THx, sets the third flag bit to a specific bit in accordance with the first input data of the n-th line.

The second bit counter 720 sequentially reads input data of the (n+1)-th line stored in the second line memory 730, counts number of cases that black detection bit data 10 and white detection bit data 11 are alternately stored. The second bit comparator 760 compares the count of the second bit counter 720 with the third threshold value THx, and if the count is greater than the third threshold value THx, sets the fourth flag bit to a specific bit in accordance with the first input data of the (n+1)-th line.

The line comparator 750 compares the third flag bit and the fourth flag bit, and if both of the third flag bit and the fourth flag bit are a specific bit, the line counter 770 compares detection bit data stored respectively in the corresponding addresses of the first line memory 725 and second line memory 730, and determines if it is a disruptive pattern. A unit disruptive pattern in the second detection method is set in units of two lines.

The line counter 770 counts when it is a unit disruptive patterns.

Moreover, the (n+2)-th line and (n+3)-th line stored respectively in the first line memory 725 and second line memory 730 are input into the first bit counter 715 and the second bit counter, respectively, and the same operation continues.

The line comparator 750 compares the third flag bit of the (n+2)-th line and the fourth flag bit of the (n+1)-th line, and if both of the third flag bit and the fourth flag bit are a specific bit, the line counter 770 determines if it is a disruptive pattern and counts this unit disruptive pattern.

If the count of the line counter 770 through the above consecutive process is greater than the fourth threshold value THy, the pattern determiner 780 determines that there is a disruptive pattern, and outputs the detection result PRE.

The above-explained FIG. 7 is a view showing a threshold value of a unit disruptive pattern to explain the second detection method.

The detector 710 reads input data line by line, and writes detection bit data in the corresponding one of the first line memory 725 and second line memory 730 in response to a detection result of color information. In an example of FIG. 7, detection bit data of the n line and (n+2) line is written in the first line memory 725, and detection bit data of the (n+1) and (n+3) lines are written in the second line memory 730.

A repetitive description will be omitted because the second detection method is similar to the above-described first detection method, except that detection bit data stored in the corresponding line memories in units of two lines are compared with each other, and then the case that white detection bit data and black detection bit data are alternately stored is counted.

One of the disruptive pattern detection methods according to some embodiments may include a third detection method for detecting a disruptive pattern by using a frame memory.

According to the third detection method, input data is read, and detection bit data is written frame by frame in the corresponding address of a frame memory.

The frame memory may have a capacitance large enough to store a predetermined masking area, or a capacitance large enough to store an area having at least a number of lines which is smaller by 1 than the number of lines of the masking area.

A data value corresponding to the size of the masking area is read from the detection bit data stored frame by frame in the frame memory to count a unit disruptive pattern and therefore determine the presence or absence of a disruptive pattern.

The size of the masking area and the number of extractions of image data to be compared with the masking area from the detection bit data stored in the frame memory are set.

The masking area refers to a unit disruptive pattern area which becomes a criterion for detecting a disruptive pattern. A 1-dot pattern may be a pixel block of white and black alternating in vertical and lateral directions, and the number of repetitions of white and block or the size of the block may be arbitrarily determined. As in the example of FIG. 7, a dot area defined by four pixels in a direction (horizontal direction) and four pixels in another direction (vertical direction) may be set as the masking area.

Image data to be compared with the masking area data may be extracted a plurality of times from the frame memory.

The size of the masking area and the number of extractions of image data may be determined according to the total size of data, the operation amount, and so on.

The image data may be compared directly with the masking area data, but the disclosed embodiments are not limited thereto and image data having a size corresponding to that of the masking area is read from the frame memory to determine it takes the form of a unit disruptive pattern.

In an example, it is assumed that a masking area of A×B size is a unit disruptive pattern of the 1-dot pattern, and image data corresponding to the A×B size is extracted five times from the frame memory.

Comparison between masking area data and image data involves performing an XOR operation of detection bit data of pixels disposed in the same position in each area.

That is, if all results of the XOR operation of the masking area data and the image data are 0 or 1, the image data is determined to have a matching pattern to the masking area having the 1-dot pattern and a unit disruptive pattern is counted.

If the image data extracted for a session is determined to have a matching pattern to the masking area, the count is incremented by 1. Thus, if the total count is greater than the fifth threshold value THz, the input data of the corresponding frame is determined to have a disruptive pattern. The fifth threshold value THz is not specifically limited, but may be determined depending on the size of the masking area and the number of extractions of the image data.

Figure 9:
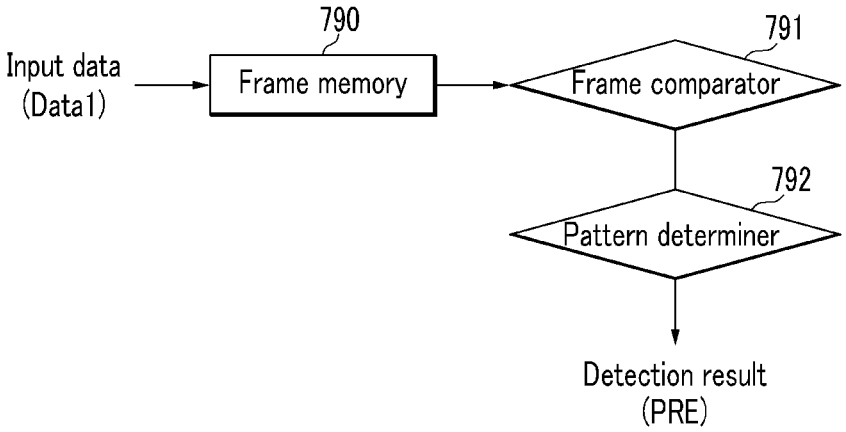

FIG. 9 shows a block diagram of the data determiner 7 according to some embodiments. That is, the data determiner 7-3 of FIG. 9 includes means that performs the third detection method to detect a disruptive pattern by using a frame memory.

As shown in FIG. 9, the data determiner 7-3 includes a frame memory 790, a frame comparator 791, and a pattern determiner 792.

The frame memory 790 reads input data Data1 and writes detection bit data and writes detection bit data frame by frame.

As detection bit data is written frame by frame, color information of image data displayed by all the pixels of the display panel during a frame is written. For example, detection bit data '0' is written in the address corresponding to a pixel that receives input data for displaying white, or detection bit data '1' is written in the address corresponding to a pixel that receives input data for displaying black.

The frame comparator 791 compares image data having a size corresponding to a masking area extracted from the frame memory with preset masking area data. That is, an XOR operation of respective detection bit data corresponding to the same position in the image data and the preset masking area data is performed, and the case that the results of the XOR operation are 0 or 1 is counted.

For example, in the case of a 1-dot pattern in which a masking area is set to an 2×2 area, the color of light emitted from pixels corresponding to the matrix positions (1,1), (1,2), (2,1), and (2,2) are alternating colors of white and black. Accordingly, it is assumed that bit data is arranged in the order of 0, 1, 1, and 0.

In this case, image data extracted from the frame memory is displayed in alternating white and black, the detection bit data of the pixels corresponding to the corresponding matrix positions is arranged in the order of 0, 1, 1, and 0 or in the order of 1, 0, 0, and 1.

All results of the XOR operation of the bit data 0, 1, 1, 0 of the masking area and the bit data 0, 1, 1, 0 of the image data are 0. All results of the XOR operation of the bit data 0, 1, 1, 0 of the masking area and the bit data 1, 0, 0, 1 of the image data are 1.

As such, a unit disruptive pattern is counted only when all results of the XOR operation are 0 or 1.

Then, image data having a size corresponding to the masking area is extracted from the frame memory, and the image data is compared with the masking area data. The image data extracted repeatedly a predetermined number of times and the masking area data are compared, and the count of all results of 0 or 1 is transmitted to the pattern determiner 792.

The pattern determiner 792 determines if the count of all results 0 or 1 of comparison between the image data extracted repeatedly a predetermined number of times and the masking area data is greater than the fifth threshold value THz, and if the count is greater than the fifth threshold value THz, determines that the corresponding frame input data is a disruptive pattern. Then, the detection result PRE is output.

Figure 10:
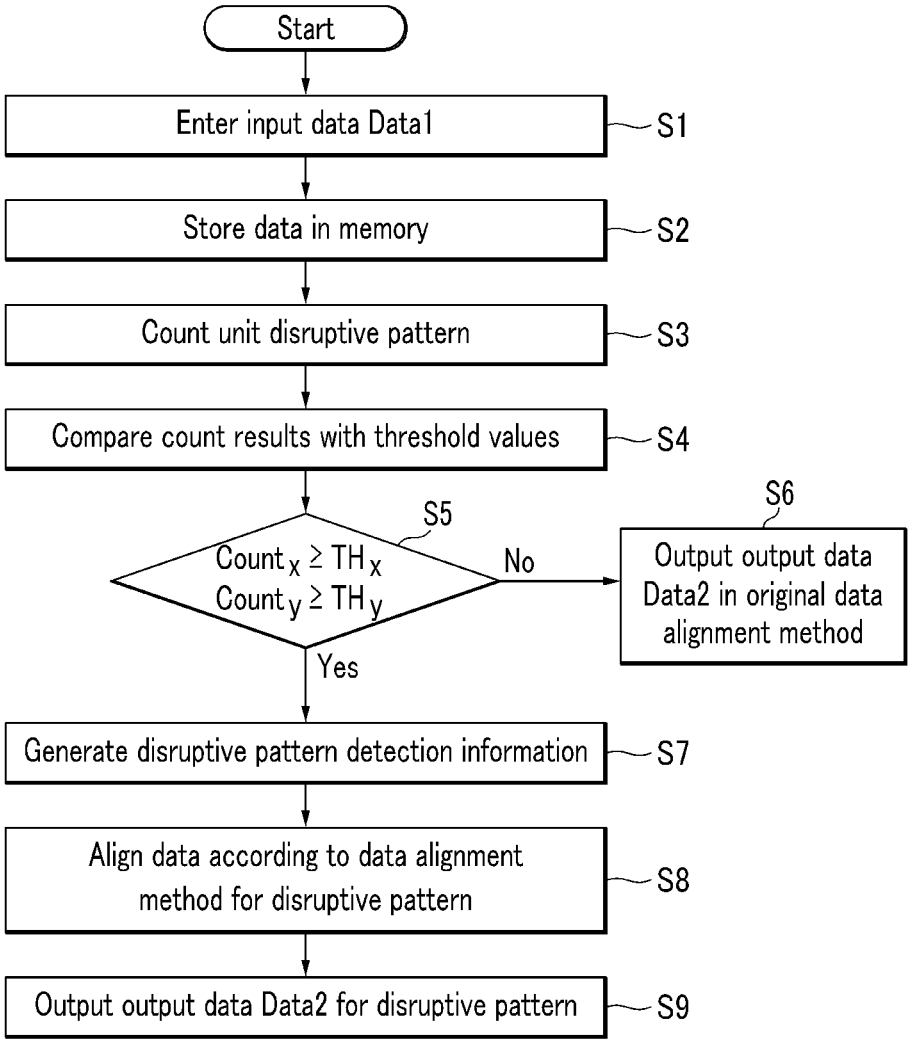
FIG. 10 is a flowchart showing a data processing method of a display device according to some embodiments.

FIG. 10 is a flowchart showing a data processing method of a display device according to some embodiments.

Methods of detecting a disruptive pattern in the flowchart of FIG. 10 include the above-described first to third detection methods.

First, input data Data1 is input from the outside to the controller (S1).

Then, the input data may be stored in the memory (S2). In detail, detection bit data generated in response to color information of pixels included in the input data is written. The detection bit data may be stored per frame or line of input data according to a detection method according to some embodiments.

The corresponding step in the first detection method may be omitted because a pattern is detected by reading information directly from input data.

A unit disruptive pattern of the detection bit data stored in the memory is counted according to a detection method (S3). According to a detection method, in some embodiments, the unit disruptive pattern may be a pattern of consecutively alternating white and black images for each line, or a pattern of white and black images alternating in vertical and lateral directions for a predetermined area.

The count is increased by repeatedly detecting a unit disruptive pattern for each line or for a predetermined area, and the count is compared with a threshold value (S4).

Specifically, in the step S5, the count of unit disruptive patterns for each line is compared with the first threshold value THx based on the first detection method and the second detection method, and an alternating pattern of input data for each line is counted and the count is compared with the second threshold value THy. However, in the third detection method, the step S5 is not performed, but a unit disruptive pattern is counted when input data is determined to have a matching pattern to a masking area for a predetermined area. The count is compared with a threshold value.

If the count is not greater than the threshold value, the input data is considered not including a disruptive pattern, and therefore output data Data2 is generated using the original data alignment method in the step S6. The output data Data2 includes field data divided into fields constituting a frame for time-division driving.

On the other hand, if the count is greater than the threshold value, the corresponding input data is considered including a disruptive pattern, and detection information is generated in the step S7.

Next, the corresponding input data is aligned as data for each field according to a data alignment method for a disruptive pattern according to some embodiments (S8).

By using the data for each field aligned in a new method in the step S8, output data Data2 for the input data containing a disruptive pattern is generated and output (S9).

If input data is considered containing a disruptive pattern according to the above-described some embodiments, the data aligner 8 of the controller 5 arranges data for each field by using a data alignment method for preventing picture distortion caused by the disruptive pattern. Then, output data for time-division driving is generated to display an image containing a disruptive pattern.

Figure 11:
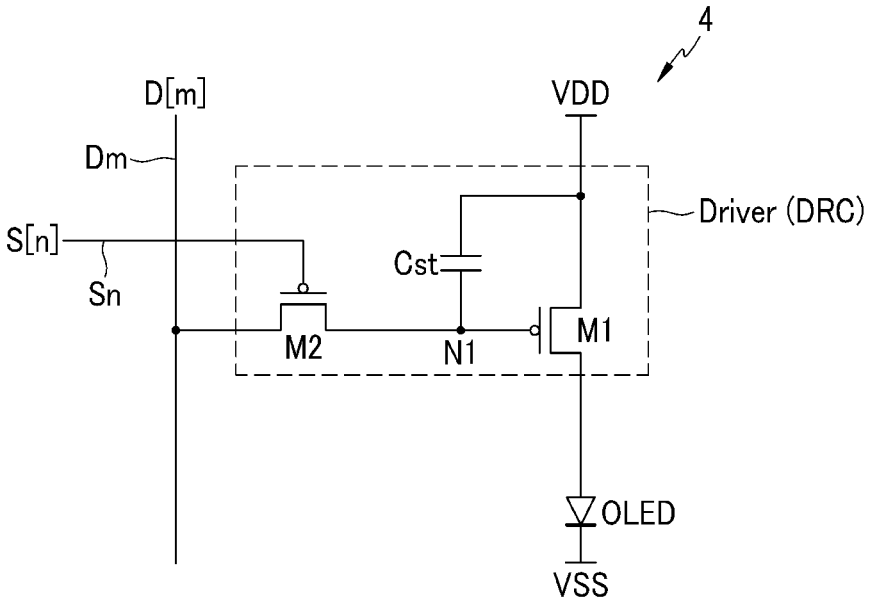
FIG. 11 is a circuit diagram showing a pixel structure of the display device according to the some embodiments.

A circuit diagram according to some embodiments of the structure of each pixel of the display panel driven upon receipt of the output data is shown in FIG. 11.

A pixel of FIG. 11 illustrates a generally driven circuit, and the pixel 4 includes a driver DRC and an organic light emitting diode OLED that emits light by a driving current in response to a corresponding output data signal as the driver is enabled. A time difference is generated in the driving of the pixel according to whether the output data signal is first field data or second field data.

The driver DRC of the pixel 4 includes a driving transistor M1, a switching transistor M2, and a capacitor Cst.

A transistor of the pixel of FIG. 11 is illustrated as a PMOS transistor, but the disclosed embodiments are not limited thereto.

The driving transistor M1 is a transistor for driving the organic light emitting diode OLED, and controls the driving current flowing to the organic light emitting diode OLED by a voltage difference applied between a gate electrode and a source electrode.

The switching transistor M2 is a transistor that selects the pixel 4 in response to a corresponding scan signal S[n] and enables the driver DRC thereof. When the switching transistor M2 is turned on in response to the scan signal S[n] supplied through a scan line Sn, it receives a corresponding data signal D[m] through the data line Dm and applies the relevant data voltage to the first node N1. Accordingly, a gate electrode voltage of the driving transistor M1 becomes the data voltage. The data signal D[m] may be a corresponding data signal of first field data or a corresponding data signal of second field data according to whether the corresponding pixel is a first pixel or second pixel.

A capacitor Cst is connected between the first node N1 and the source electrode of the driving transistor M1, and stores a voltage corresponding to the voltage difference applied to both electrodes. The data voltage transmitted as the driver DRC is enabled is applied to a first electrode, a voltage corresponding to the difference between the data voltage and a first power voltage applied to a second electrode. Then, the driving transistor M1 generates a driving current in response to the corresponding stored voltage and causes the driving current to flow to the organic light emitting diode OLED.

A color arrangement pattern according to the time-division driving of the display panel consisting of a plurality of pixels having the structure as shown in the embodiment of FIG. 11 and a data alignment method using the same will be described below in detail.

That is, a data alignment method for the data aligner 8 of the controller 5 to receive a detection result containing a disruptive pattern and generate output data according to time-division driving and a driving process thereof will be described.

FIG. 12 is a view showing a map of input data Data1 of a display device according to some embodiments. FIG. 12 shows the address of data input to subpixels corresponding to some part of the display panel in order to easily display an output data map arranged according to a data alignment method according to some embodiments.

Specifically, FIG. 12 shows the arrangement of data associated with specific positions of subpixels of a plurality of pixels included in the first to fourth pixel lines L1 to L4 and transmitted to the subpixels.

According to FIG. 11, each pixel of the display panel 1 includes an organic light emitting diode. Thus, data to be transmitted from the data driver 3 is sequentially arranged line by line in the order of an R subpixel emitting red light, a G subpixel emitting green light, and a B subpixel emitting blue light. In FIG. 12, data to be transmitted to each subpixel may be designated in the order of color, a corresponding line of an emitting subpixel, and a corresponding column of a pixel including the subpixel. For example, R23 is red signal data which is included in the third pixel provided in the second pixel line L2 and transmitted to the subpixel emitting red light.

Output data for each field arranged by the first alignment method among the data alignment methods according to time-division driving are shown in FIGS. 13A and 13B. The first alignment method is a method of alignment by adding black data between neighboring field data.

Referring to FIG. 13A and FIG. 13B, first field output data is generated by dividing a plurality of first field data line by line and adding black data between two neighboring first field data among the plurality of first field data. Likewise, second field output data is generated by dividing a plurality of second field data line by line and adding black data between two neighboring second field data among the plurality of second field data.

FIG. 13A is a map of first field output data Data1-1(B) output to first pixels in the first field 1SF, and FIG. 13B is a map of second field output data Data1-2(B) output to second pixels in the second field 2SF.

According to the data alignment method according to the embodiment of FIG. 13A and FIG. 13B, a plurality of first pixels emitting light in the first field may be odd-numbered subpixels included in each pixel line of the display panel. Furthermore, a plurality of second pixels may be the remaining subpixels excepting the first pixels, i.e., even-numbered subpixels included in each pixel line.

The first field data Data1-1(B) transmitted to the plurality of first pixels may be aligned such that red (R), blue (B), and green (G) are alternately displayed along a pixel column. The second field data Data1-2(B) transmitted to the plurality of second pixels may be aligned such that green (G), red (R), and blue (B) are alternately displayed along a pixel column. At this point, black data is inserted between pixel columns of the first pixels or second pixels. Insertion of black data involves inputting a data value for emitting light at a black luminance, or not driving subpixels between the pixel columns of the first pixels or second pixels to cause them to emit no light.

In the first field output data Data1-1(B), output data R11, R21, R31, R41 transmitted to the first pixels corresponding to the first pixel column is red data for emitting red light, output data B11, B21, B31, B41 transmitted to the first pixels corresponding to the third pixel column is blue data for emitting blue light, and output data G12, G22, G32, G42 transmitted to the first pixels corresponding to the fifth subpixel is green data for emitting green light. Next, the output data is aligned such that the order of colors repeatedly changes every subsequent odd column. Moreover, black data may be inserted into the pixels (second pixels) provided between the pixel columns.

The data arrangement of the second field output data Data1-2(B) of FIG. 13B is opposite to that of FIG. 13A. That is, output data G11, G21, G31, and G41 transmitted to the second pixels corresponding to the second pixel column is green data for emitting green light, output data R12, R22, R32, and R42 transmitted to the second pixels corresponding to fourth pixel column is red data for emitting red light, and output data B12, B22, B32, and B42 transmitted to the second pixels corresponding to the sixth pixel column is blue data for emitting blue light. Next, the output data is aligned such that the order of colors repeatedly changes every subsequent even column. Moreover, black data may be inserted into the pixels (first pixels) provided between the pixel columns.

Figure 14A:
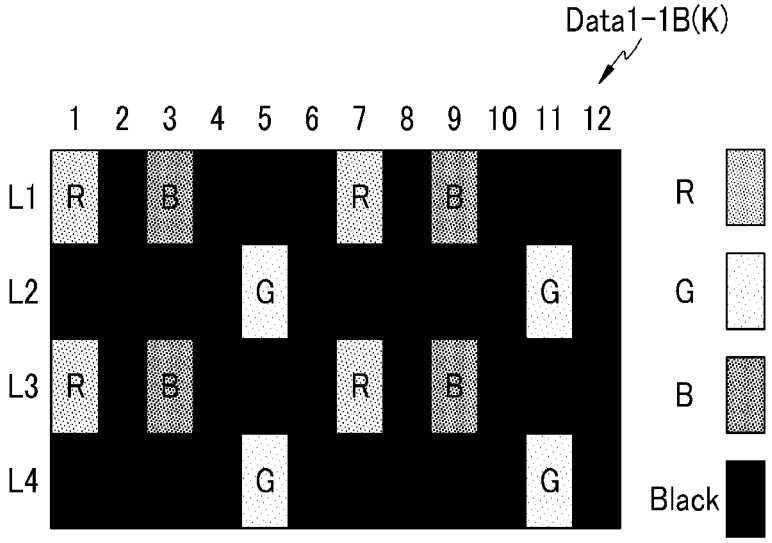
FIG. 14A and FIG. 14B are views showing the fields in which a 1-dot pattern is displayed according to the data arrangement of FIGS. 13A and 13B.
Figure 14B:
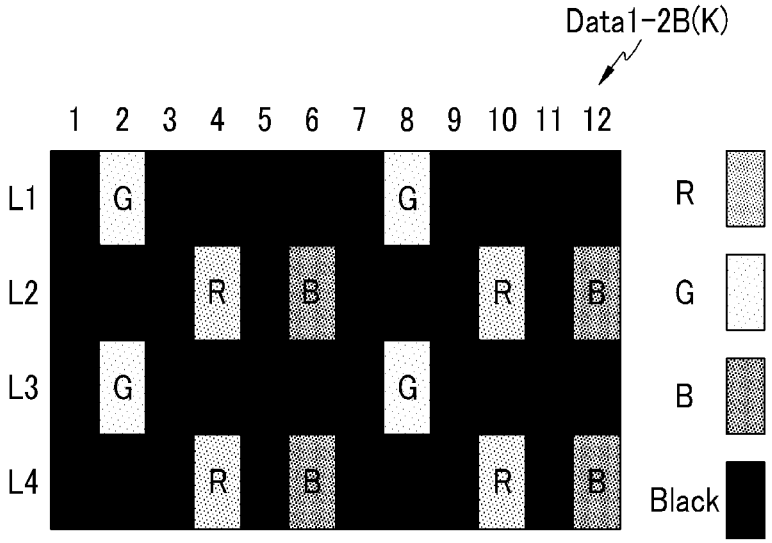

FIG. 14A and FIG. 14B are views showing the fields in which a 1-dot pattern is displayed as an example of a disruptive pattern according to the data arrangement for each field of FIGS. 13A and 13B.

A display pattern corresponding to input data having the 1-dot pattern is a pattern in which a pixel that includes three RGB subpixels and emits light at maximum luminance and another pixel that is adjacent to the pixel and emits no light in accordance with black data, which is minimum luminance data, are repeated in vertical and lateral directions.

Therefore, in an image of the first field of the 1-dot pattern, as shown in FIG. 14A, green data G12 transmitted to the pixels corresponding to the second column of the first pixel line L1 is black data, and green data G14 transmitted to the pixels corresponding to the fourth column is black data, too. Red and blue data transmitted to the remaining first and third pixel columns are transmitted at the maximum luminance, thereby making the corresponding subpixels emit light.

In the second pixel line L2, R21 and B21 data and R23 and B23 data are black data. Further, G22 data and G24 data are transmitted at the maximum luminance, thereby emitting light from the corresponding subpixels.

In the third pixel line L3 and the fourth pixel line L4, color data transmitted to the pixels corresponding to the same pixel columns as the first pixel line L1 and the second pixel line L2 is black data.

Accordingly, red, green, and blue light are alternately emitted for each pixel line, thereby displaying a first field image Data1-1B(K) of the 1-dot pattern.

In FIG. 14B, color data transmitted to the pixels corresponding to the same pixel columns as those in FIG. 14A for each pixel line is black data. G11 data and G13 data of the first pixel line L1, R22 and B22 data and R24 and B24 data of the second pixel line L2, G31 data and G33 data of the third pixel line L3, and R42 and B42 data and R44 and B44 data of the fourth pixel line L4 have the maximum luminance value, and the corresponding subpixels emit light in the corresponding colors.

Accordingly, green, red, and blue light are alternately emitted for each pixel line, thereby displaying a second field image Data1-2B(K) of the 1-dot pattern.

Referring to FIG. 14A and FIG. 14B, it can be seen that color separation phenomenon in time-division driving does not occur because the display panel for each field uniformly displays colors of red, blue, and green.

Figure 15:
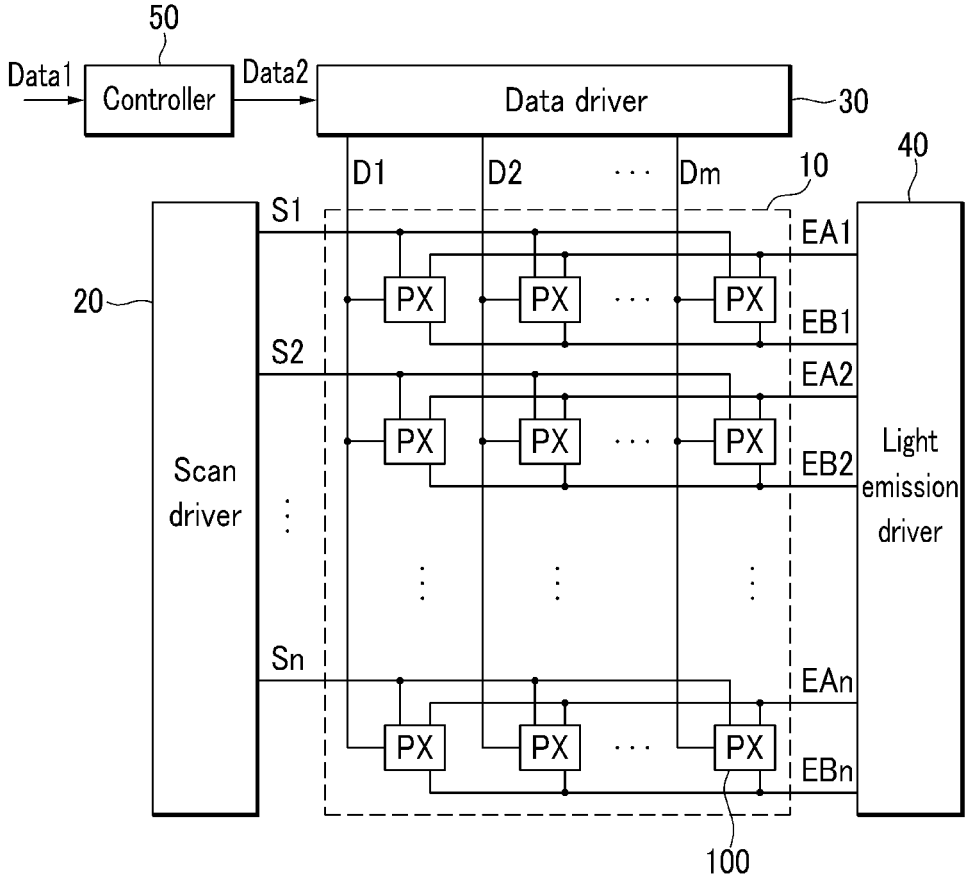
FIG. 15 is a schematic block diagram of a display device according to some embodiments.

FIG. 15 is a schematic block diagram of a display device according to some embodiments.

The display device of FIG. 1 includes a display panel 10 including a plurality of pixels PX having different circuit configurations in accordance with time-division driving, unlike the general display panel 1 of the display device of FIG. 14. Accordingly, unlike FIG. 4, the display device of FIG. 15 further includes a light emission driver 40 for dividing at least one light emitting element included in a pixel into fields and causing it to emit light.

For convenience, the following description will be given focusing on the configuration of the display device different from that of FIG. 4.

Each pixel PX of the display panel of FIG. 15 comprises at least one light emitting element that displays predetermined colors of R, G, and B for each of fields in time division driving method during a frame. In an example, pixels consecutive in a horizontal direction of a pixel line may each comprise two light emitting elements, and these light emitting elements may sequentially emit R, G, and B color data.

In the case that each pixel comprises two light emitting elements, when performing time-division driving in two separate fields, a plurality of pixels may be grouped into a first subpixel group comprising a plurality of first light emitting elements for emitting light in the first field and a second subpixel group comprising a plurality of second light emitting elements for emitting light in the second field.

The light emission driver 40 is connected to the plurality of pixels via a plurality of first light emission control lines EA1-EAn and a plurality of second light emission control lines EB1-EBn.

The light emission driver 40 sequentially applies a first light emission control signal to the corresponding first light emission control lines EA1 to EAn and a second light emission control signal to the corresponding second light emission control lines EB1-EBn in order to control light emission from the light emitting elements included in the pixel PX. That is, each pixel PX according to some embodiments comprises a plurality of light emitting elements displaying R, G, and B colors, and the first and second light emission control signals supplied from the light emission driver 40 control light emission for each field so that the entire display panel 10 has different color arrays for each field of a frame.

Figure 16:
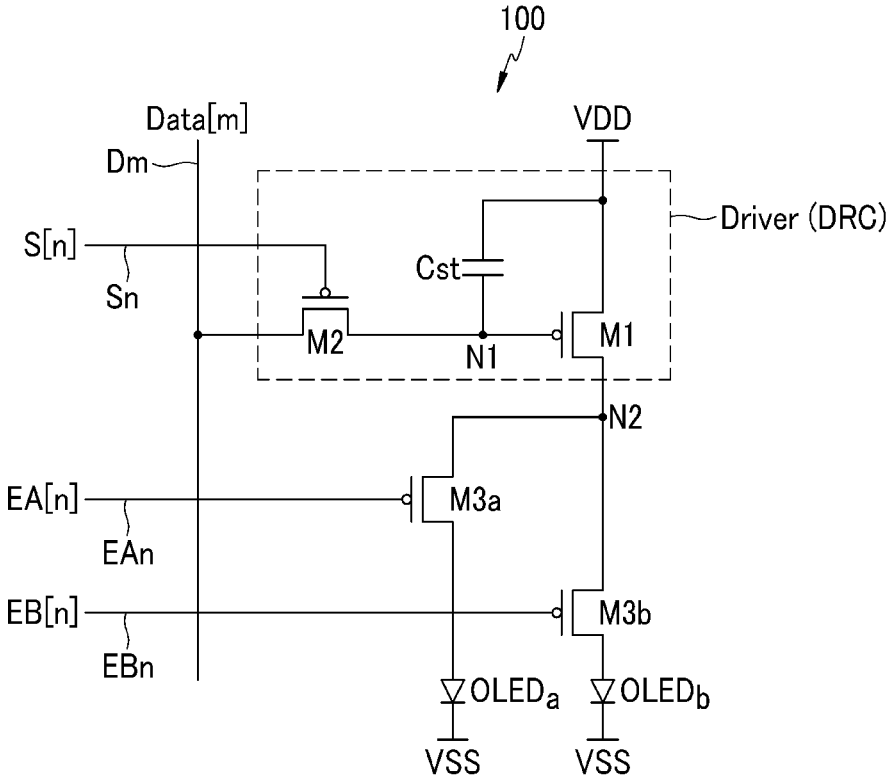
FIG. 16 is a circuit diagram showing a pixel structure of the display device of FIG. 15.

FIG. 16 is a circuit diagram showing a pixel structure of the display device of FIG. 15. Specifically, the pixel 100 of FIG. 16 is a pixel 100 which is provided in an area defined by the last row and the last column in the matrix structure of the display panel 10 of FIG. 15. The pixel structure of FIG. 16 is similar to the pixel structure of FIG. 11, so a description thereof will be made focusing on different components.

The pixel 100 includes a driver DRC and at least two organic EL elements OLEDa and OLEDb that emit light by a driving current in response to a corresponding data signal as the driver is enabled. The pixel 100 includes two organic EL elements OLEDa and OLEDb that emit light in respective fields if two fields are included during a frame.

The first organic light emitting element OLEDa is connected to a first light emitting transistor M3*a*, and the second organic light emitting element OLEDb is connected to a second light emitting transistor M3*b*.

The first light emitting transistor M3*a* is a transistor that controls the light emission of the first organic light emitting element OLEDa, and includes a source electrode connected to a second node N20, a gate electrode connected to the corresponding first light emission control line EAn, and a drain electrode connected to an anode of the first organic light emitting element OLEDa.

The second light emitting transistor M3*b* is a transistor that controls the light emission of the second organic light emitting element OLEDb, and includes a source electrode connected to the second node N20, a gate electrode connected to the corresponding second light emission control line EBn, and a drain electrode connected to an anode of the second organic light emitting element OLEDb.

When each frame is time-divisionally driven as two fields, the first organic EL element OLEDa emits light in the first field by driving current by the turn-on of the first light emitting transistor M3*a*, and the organic light emitting element OLEDb emits light in the second field by driving current by the turn-on of the second light emitting transistor M3*b*. At this point, the first light emitting transistor M3*a* is turned in response to the first light emission control signal EA[n] applied to the gate electrode, and the second light emitting transistor M3*b* is turned on in response to the second light emission control signal EB [n] applied to the gate electrode.

The two organic light emitting elements OLEDa and OLEDb emit light of different colors. That is, they may emit light of red and green, light of blue and red, and light of green and blue. The two organic light emitting elements OLEDa and OLEDb included in pixels neighboring in a horizontal direction may sequentially emit light in the order of red (R), green (G), and blue (B).

FIG. 17A and FIG. 17B show data maps for respective fields in accordance with the second alignment method among the data alignment methods according to some embodiments. As shown in FIG. 13A and FIG. 13B, the data maps are extracted from a map of the input data Data1 of FIG. 12.

The data values indicated in FIG. 17A and FIG. 17B show data values with which any one of the two organic EL elements included in a pixel emits light. Hence, the concept of an R subpixel, a G subpixel, and a B subpixel stated in the description of FIG. 12 should be replaced by the concept of organic EL elements emitting light of RGB colors.

For example, "R23" of FIG. 12 is red signal data which is to be transmitted to the organic EL element emitting red light included in the fourth pixel provided in the second pixel line L2. This is because the data map shown in FIG. 12 may be replaced by a map mainly involved with organic EL elements that emit colors, and two organic EL elements are included in a pixel according to FIG. 16.

According to the second alignment method, the first field data Data1-1(BF) of FIG. 17A is transmitted to the plurality of first light emitting elements of the display panel. The plurality of first light emitting elements emitting light in the first field may be the first organic EL elements, each of which is the first one of the two organic EL elements included in each of the plurality of pixels included in each pixel line of the display panel. The first field data Data1-1(BF) is aligned such that colors of red (R), blue (B), and green (G) are alternately displayed in the pixel line direction. RGB color data in the pixel line direction becomes a first repeating pattern unit.

According to the second alignment method, the second field data Data1-2(BF) of FIG. 17B is transmitted to the plurality of second light emitting elements of the display panel. The plurality of second light emitting elements emitting light in the second field may be the second organic EL elements, each of which is the second one of the two organic EL elements included in each of the plurality of pixels included in each pixel line of the display panel. The first field data Data1-2(BF) is aligned such that colors of green (g), red (R), and blue (B) are alternately displayed in the pixel line direction. GRB color data in the pixel line direction becomes a second repeating pattern unit.

As the first field data Data1-1(BF) and the second field data Data1-2(BF), data transmitted corresponding to the plurality of first light emitting elements or the plurality of second light emitting elements are extracted from the input data Data1 and aligned. There is no need to additionally input black data because the characteristics of a pixel structure consisting of two organic EL elements are appropriate for time-division driving.

In the first field data Data1-1(BF) of FIG. 17A, output data R11, R21, R31, and R41 transmitted to the first light emitting elements corresponding to the first subpixel column is red data, output data B11, B21, B31, and B41 transmitted to the first light emitting elements corresponding to the third subpixels is blue data, and output data G12, G22, G32, and G42 transmitted to the first light emitting elements corresponding to the fifth subpixel column is green data. Next, the output data is aligned such that the order of colors repeatedly changes every odd subpixel column.

In the first field data Data1-2(BF) of FIG. 17B, output data G11, G21, G31, and G41 transmitted to the second light emitting elements corresponding to the second subpixel column is green data, output data R11, R21, R31, and R41 transmitted to the second light emitting elements corresponding to the fourth subpixels is red data, and output data B12, B22, B32, and B42 transmitted to the second light emitting elements corresponding to the sixth subpixel column is blue data. Next, the output data is aligned such that the order of colors repeatedly changes every even subpixel column.

Figure 18A:
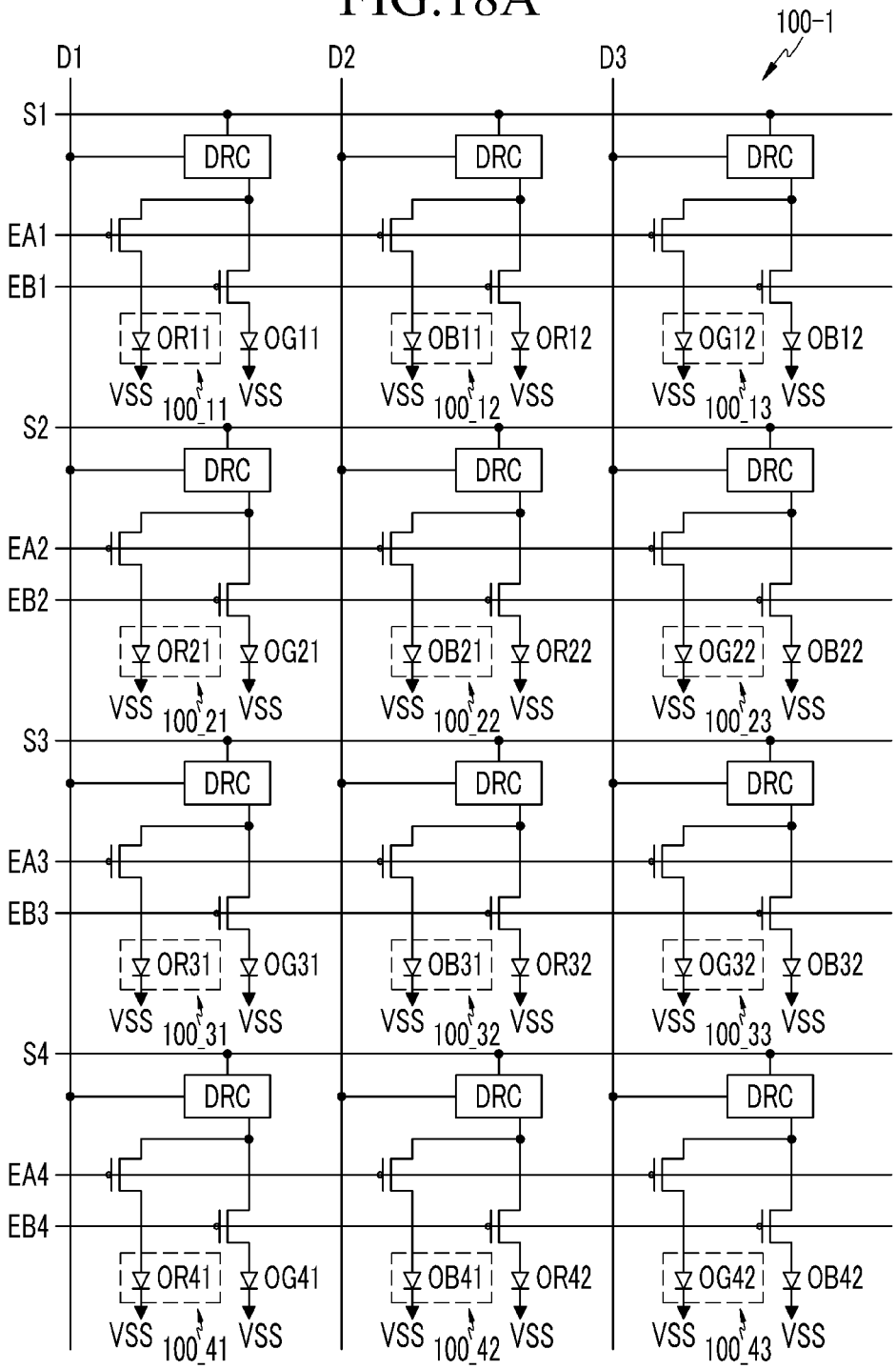
FIG. 18A and FIG. 18B are views schematically showing the driving of a pixel for respective fields in accordance with the data alignments of FIG. 17*a* and FIG. 17*b*.
Figure 18B:
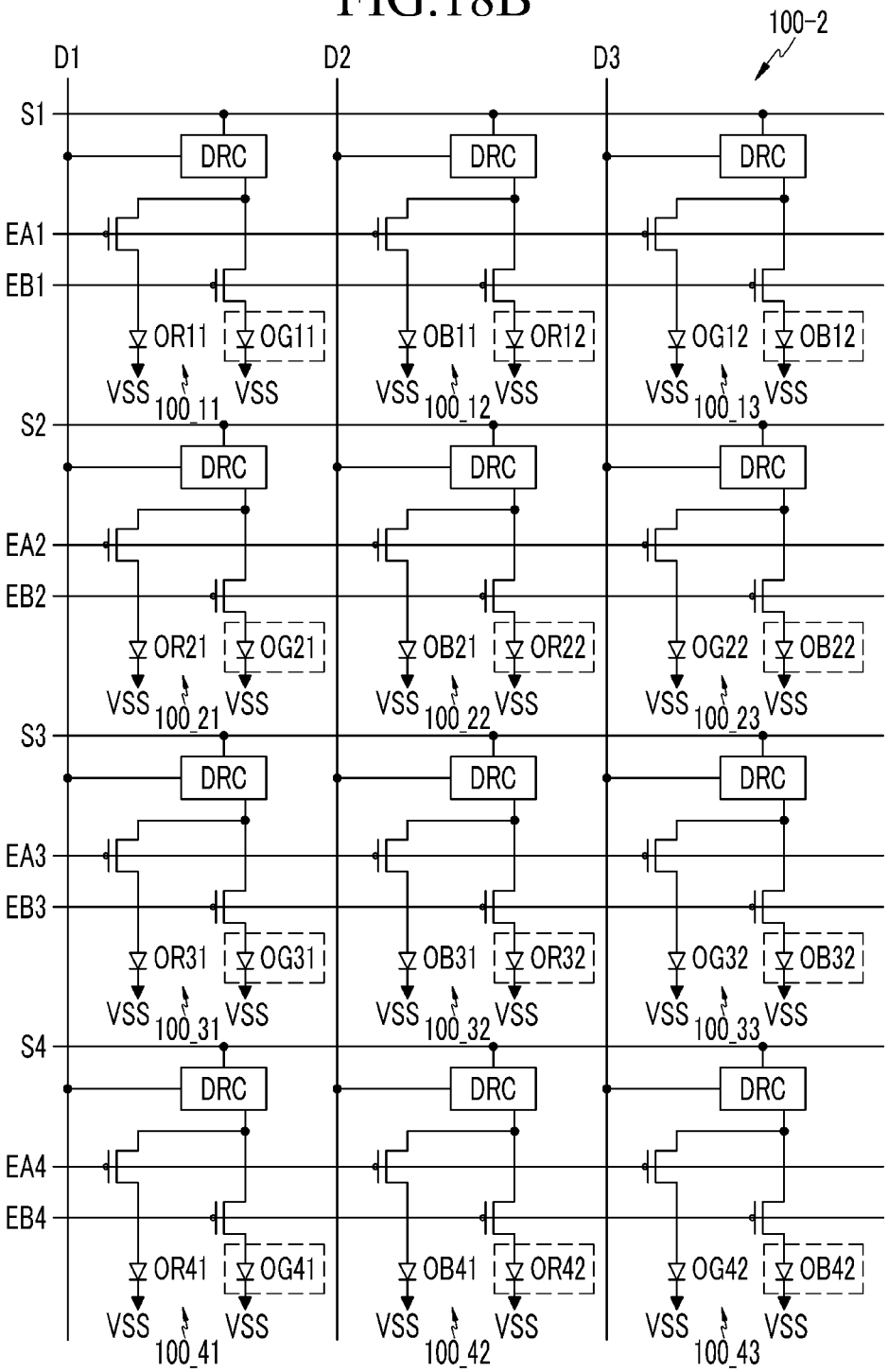

FIG. 18A and FIG. 18B are views schematically showing the driving of a pixel for respective fields in accordance with the data alignments of FIG. 17A and FIG. 17B.

FIG. 18A is a circuit diagram for explaining the driving of a pixel in an area 100_1 defined by the first repeating pattern units of four lines in the first field, and FIG. 18B is a circuit diagram for explaining the driving of a pixel in an area 100_2 defined by the second repeating pattern units of four lines in the second field. Although the circuit structures of FIG. 18A and FIG. 18B are identical to each other, the organic EL elements emitting light in the corresponding fields are different. Accordingly, the description will be made with respect to FIG. 18A for better understanding and ease of description.

In FIG. 18A, a first pixel 100_11, a second pixel 100_12, and a third pixel 100_13 are disposed in such a manner that they are included in the first pixel line L1.

Each of these pixels may be defined as including two organic EL elements, and the first light emitting element and the second light emitting element may be defined as subpixels included in a pixel.

The first light emitting element and second light emitting element in each of the first to third pixels of the respective pixel lines L1, L2, L3, and L4 corresponding to the same subpixel column are organic. EL elements that emit light of the same color, respectively, which are disposed repeatedly in the order of RGB in the horizontal direction (line direction) as shown in FIG. 18A.

In the first repeating pattern unit of FIG. 18A, light emitting transistors are respectively connected to the anodes of two organic elements included in a pixel. The light emitting transistors receive light emission control signals from the light emission control lines connected to the gate electrodes to control switching on/off.

In order to driven each of the subpixels of the display panel in accordance with image data aligned according to some embodiments, the light emission control lines need to be disposed.

The first light emission control lines EA for transmitting the first light emission control signal to control light emission in the first field and the second light emission control lines EB for transmitting the second light emission control signal to control light emission in the second field are connected to each of the pixel lines L1, L2, L3, and L4.

In response to the first light emission control signal applied to the first one of the first light emission control lines EA1, the organic elements (first light emitting elements) of R, B, and G of the first to third pixels 100_11 to 100_13 of the first pixel line L1 emit light as indicated by the dotted line. On the contrary, in response to the second light emission control signal applied to the first one of the second light emission control lines EB1, the organic elements (second light emitting elements) of G, R, and B of the first to third pixels 100_11 to 100_13 of the first pixel line L1 emit light as indicated by the dotted line. With reference to FIG. 18A and FIG. 18B, it can be seen that the first repeating pattern units and second repeating pattern units of the remaining lines are driven in the same manner.

Figure 19:
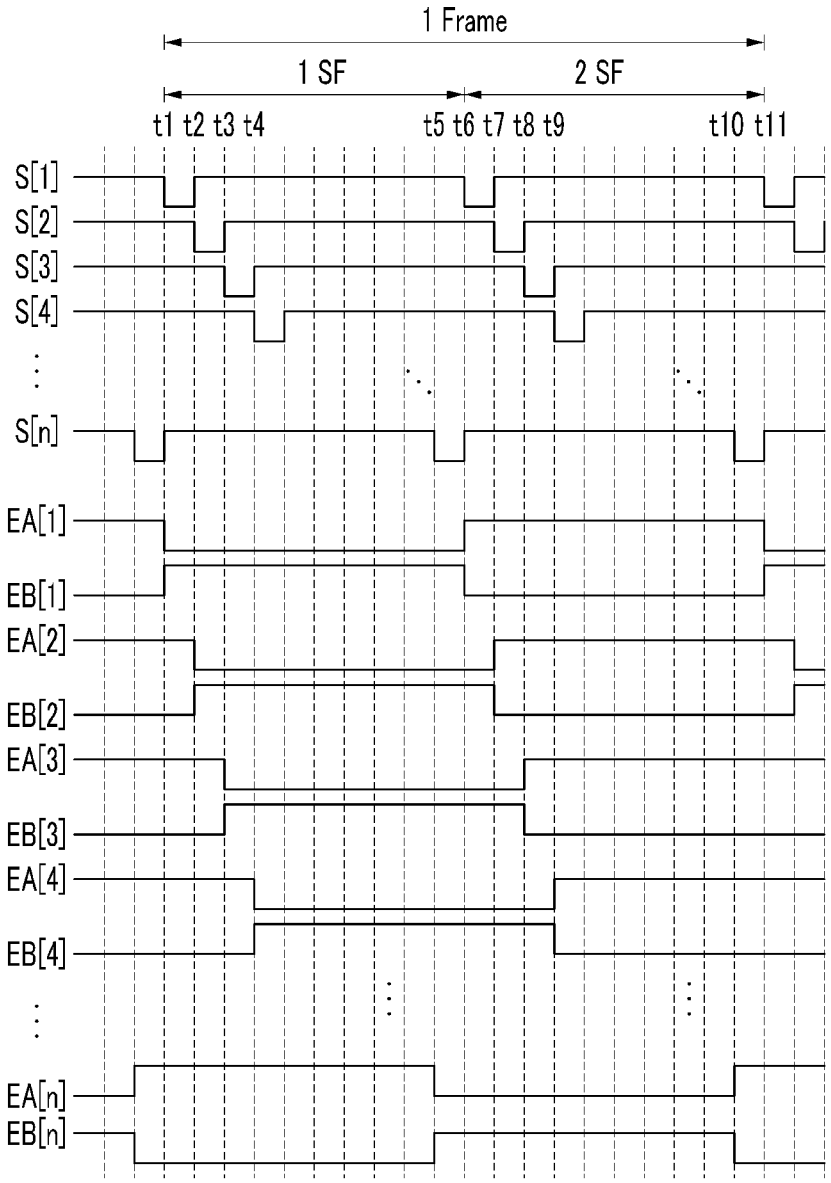
FIG. 19 is a timing diagram for explaining the driving of the pixels of FIGS. 18A and 18B.

FIG. 19 is a timing diagram for explaining the driving of the pixels of FIGS. 18A and 18B.

A frame 1 Frame is driven in two separate fields 1SF and 2SF. A frame starts by a vertical synchronization signal Vsync applied right before the time t1 and the time t11.

Because a frame image is displayed on the entire display panel by consecutive light emissions in two files during a frame, a plurality of scan signals transmitted to the display panel are transmitted at an on-level voltage of the transistors every ½ frame period.

The pixels are illustrated as each including a PMOS transistor, so the on-level voltage of the signals in FIG. 19 is a low level voltage.

The first to last scan signals S[1] to S[n] are sequentially applied at a low-level voltage to the first to last scan lines at times t1, t2, t3, t4, t5 of the first field 1SF. The first to last scan signals S[1] to S[n] are sequentially applied at a low-level voltage to the first to last scan lines at times t6, t7, t8, t9, . . . , t10 of the second field 2SF. Then, the drivers DRC of the pixels included in each pixel line are sequentially enabled.

Specifically, when the first scan signal S[1] is applied at a low level to the first scan line at time t1, first field data Data1-1 corresponding to the first field is applied from the data lines D1 to D3 respectively corresponding to the pixels included in the first pixel line.

In synchronization with the application of the first scan signal S[1] at a low level, the first light emission control signal EA[1] is applied at a low-level voltage to the first one of the first light emission control lines, and the second light emission control signal EA[1] is applied a high-level voltage, having a phase opposite to that of the low-level voltage, to the first one of the second light emission control lines.

Accordingly, in response to the first light emission control signal EA[1] applied at the low-level voltage, the first light emitting transistor is turned on, and a driving current corresponding to the first field data voltage is transmitted to the first light emitting elements through the first light emitting transistor, thereby achieving light emission. Light is emitted in the order of RBG colors in the row direction of the first pixel line.

At this point, the second light emitting transistor connected to the second light emitting element of each of the pixels of the first pixel line is turned off by the second light emission control signal EB[1] applied at the high-level voltage, and the second light emitting elements do not emit light.

In the second field, the first scan signal S[1] is applied again at a low level to the first scan line at time t6. In synchronization with the application of the first scan signal S[1], the voltage phases of the first light emission control signal EA[1] and second light emission control signal EB[1] transmitted to the first ones of the first and second light emission control lines are inverted.

Therefore, a driving current corresponding to the second field data voltage applied by the first scan signal S[1] transmitted at time t6 is transmitted to the second light emitting elements of the pixels of the first pixel line, thereby achieving light emission. Light is emitted in the order of GRB colors in the row direction of the first pixel line.

At this point, the first light emitting transistor connected to the first light emitting element of each of the pixels of the first pixel line is turned off by the first light emission control signal EA[1] with high-level voltage, and the first light emitting elements do not emit light.

Hereinafter, the remaining pixel lines are driven in the same manner, and the dotted part of FIG. 18A emits light in the first field 1SF and the dotted part of FIG. 18B emits light in the second field 2SF.

Figure 20A:
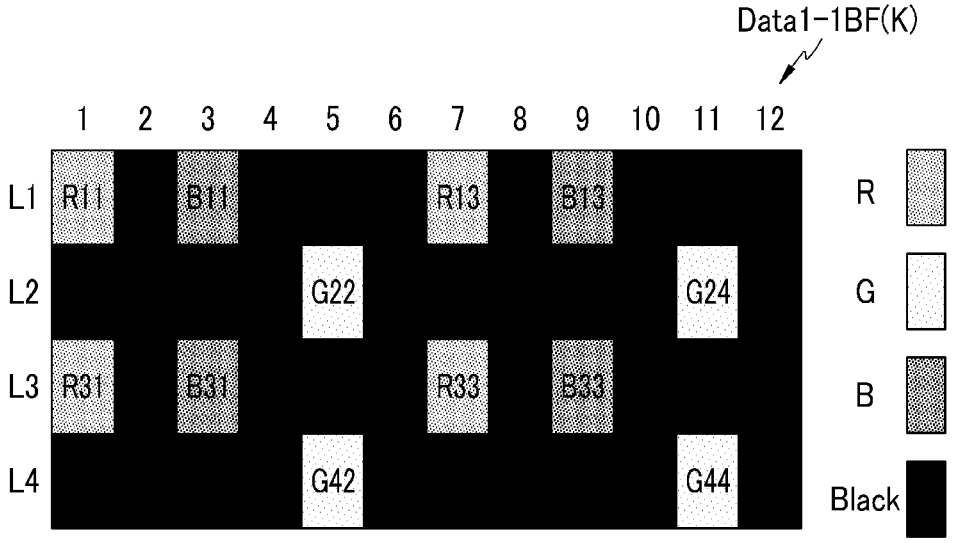
FIG. 20A and FIG. 20B are views showing the fields in which a 1-dot pattern is displayed according to the data arrangement of FIGS. 17*a* and 17*b*.
Figure 20B:
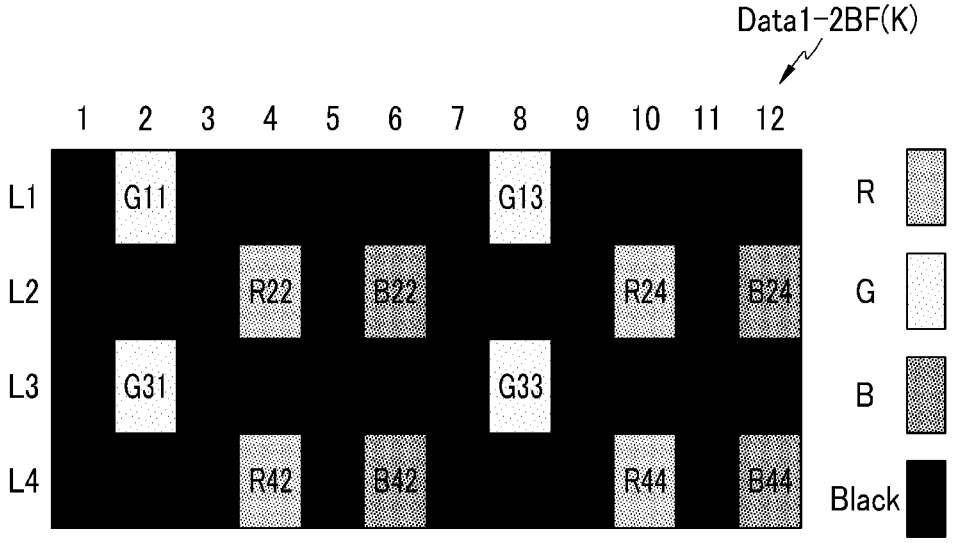

FIG. 20A and FIG. 20B are views showing the fields in which a 1-dot pattern is displayed according to the second arrangement method of FIGS. 17A and 17B.

In the 1-dot pattern, the second and fourth dot areas of the first and third pixel lines L1 and L3 and the first and third dot areas of the second and fourth pixel lines L2 and L4 display a black image.

Accordingly, out of the first field output data of FIG. 17A arranged in the second alignment method, G12 data and G14 data in the first pixel line L1 are black data in accordance with the 1-dot pattern, and light is emitted in accordance with R11, B11, R13, and B13 data.

R21 and B21 data and R23 and B23 data in the second pixel line L2 are black data, and light is emitted in accordance with G22 data and G24 data.

In the third and fourth pixel lines L3 and L4 as well, color data to be transmitted to the first light emitting elements corresponding to the same dot areas as the first and second pixel lines L1 and L2 is black data.

Hence, as shown in FIG. 20A, red, blue, and green light emissions are alternately performed for each pixel line, and the first field image Data1-1BF(K) of the 1-dot pattern is displayed.

Out of the second field output data of FIG. 17B arranged in the second alignment method, R12, B12, R14, and B14 data in the first pixel line L1 are black data in accordance with the 1-dot pattern, and light is emitted in accordance with G11 data and G13 data.

In the second pixel line L2, G21 data and G23 data are black data, and light is emitted in accordance with R22 and B22 data and R24 and B24 data.

In the third and fourth pixel lines L3 and L4 as well, color data to be transmitted to the second light emitting elements corresponding to the same dot areas as the first and second pixel lines L1 and L2 is black data.

Hence, as shown in FIG. 20B, green, red, and blue light emissions are alternately performed for each pixel line, and the second field image Data1-2BF(K) of the 1-dot pattern is displayed.

Accordingly, as can be seen from FIGS. 20A and 20B, if the 1-dot pattern, which is a disruptive pattern, is displayed in accordance with data for each field re-arranged according to the second alignment method, this prevents picture distortion in each field, and especially red light emission is distributed over each field, thereby preventing color separation.

FIG. 21A and FIG. 21B show data maps for respective fields in accordance with a third data alignment method among the data alignment methods according to some embodiments. Like a data alignment method according to some embodiments, the data maps are extracted from a map the input data Data1 of FIG. 12.

Like FIG. 17A and FIG. 17B, FIG. 21A and FIG. 21B show data values with which any one of the two organic EL elements included in a pixel emits light.

According to the third alignment method, the first field data Data1-1(NF) of FIG. 21A is transmitted to the plurality of first light emitting elements of the display panel.

As the first field data Data1-1(NF), R11, B11, G12, R13, B13, and G14 data and R41, B41, G42, R43, B43, and G44 data transmitted to the first light emitting elements of odd numbers of the first and fourth pixel lines L1 and L4 are extracted from an input data map and aligned.

Furthermore, as the first field data Data1-1(NF), G21, R22, B22, G23, R24, and B24 data and G31, R32, B32, G33, R34, and B34 data transmitted to the first light emitting elements of even numbers of the second and third pixel lines L2 and L3 are extracted and aligned.

Meanwhile, according to the third alignment method, the second field data Data1-2(NF) of FIG. 21B is transmitted to the plurality of second light emitting elements of the display panel.

As the second field data Data1-2(NF), data for displaying GRBGRB to be transmitted to the second light emitting elements of even numbers of the first and fourth pixel lines L1 and L4 is extracted from an input data map, and data for displaying RBGRBG to be transmitted to the second light emitting elements of odd numbers of the second and third pixel lines L2 and L3 is extracted from the input data map and aligned.

Referring to FIG. 21A and FIG. 21B, it can be seen that a second repeating pattern unit according to the third alignment method is color data of an area defined by the first to third subpixel columns of the first to fourth pixel lines L1 to L4.

Figure 22A:
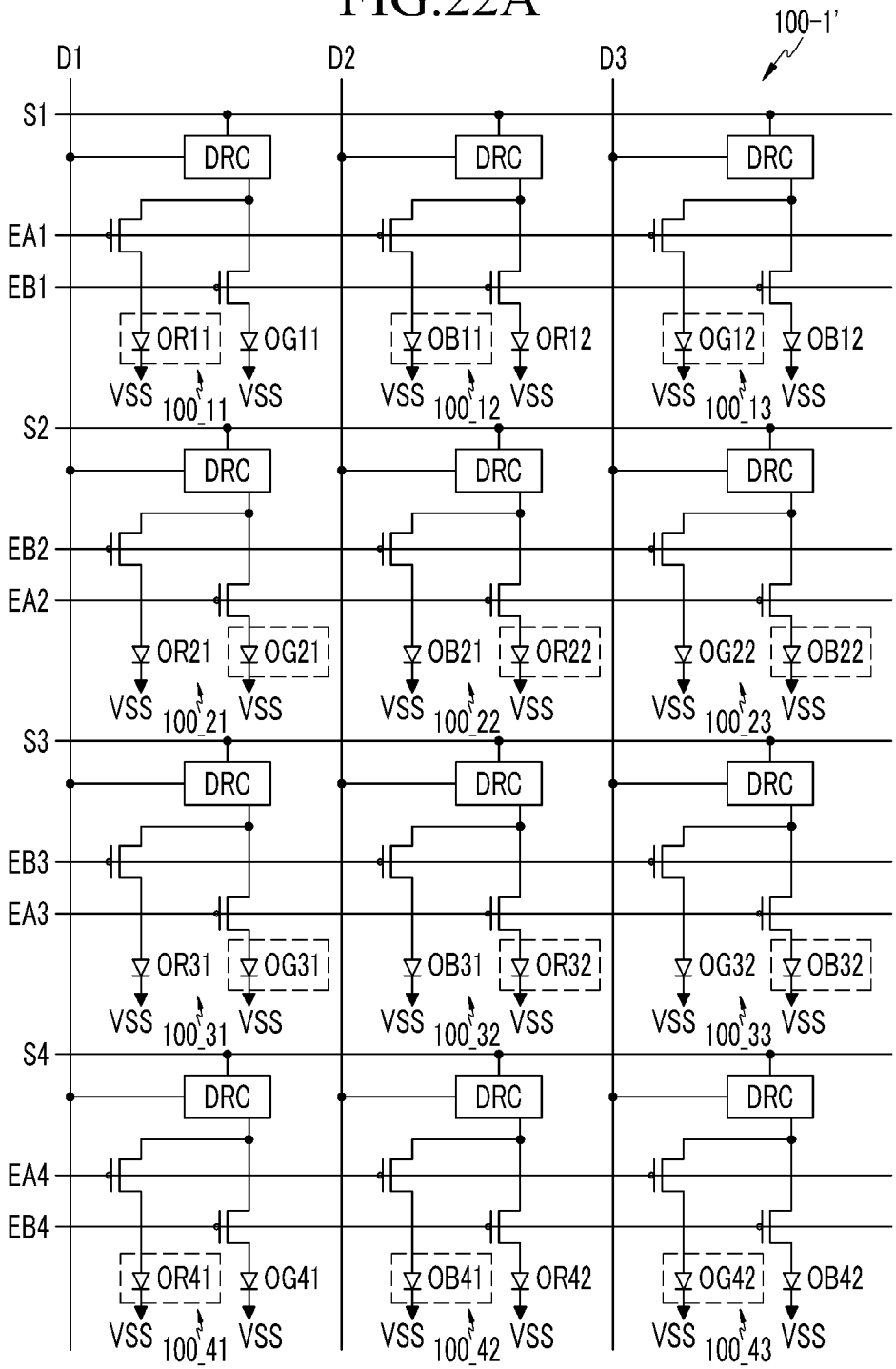
FIG. 22A and FIG. 22B are views schematically showing the driving of a pixel for respective fields in accordance with the data alignments of FIG. 21A and FIG. 21B.
Figure 22B:
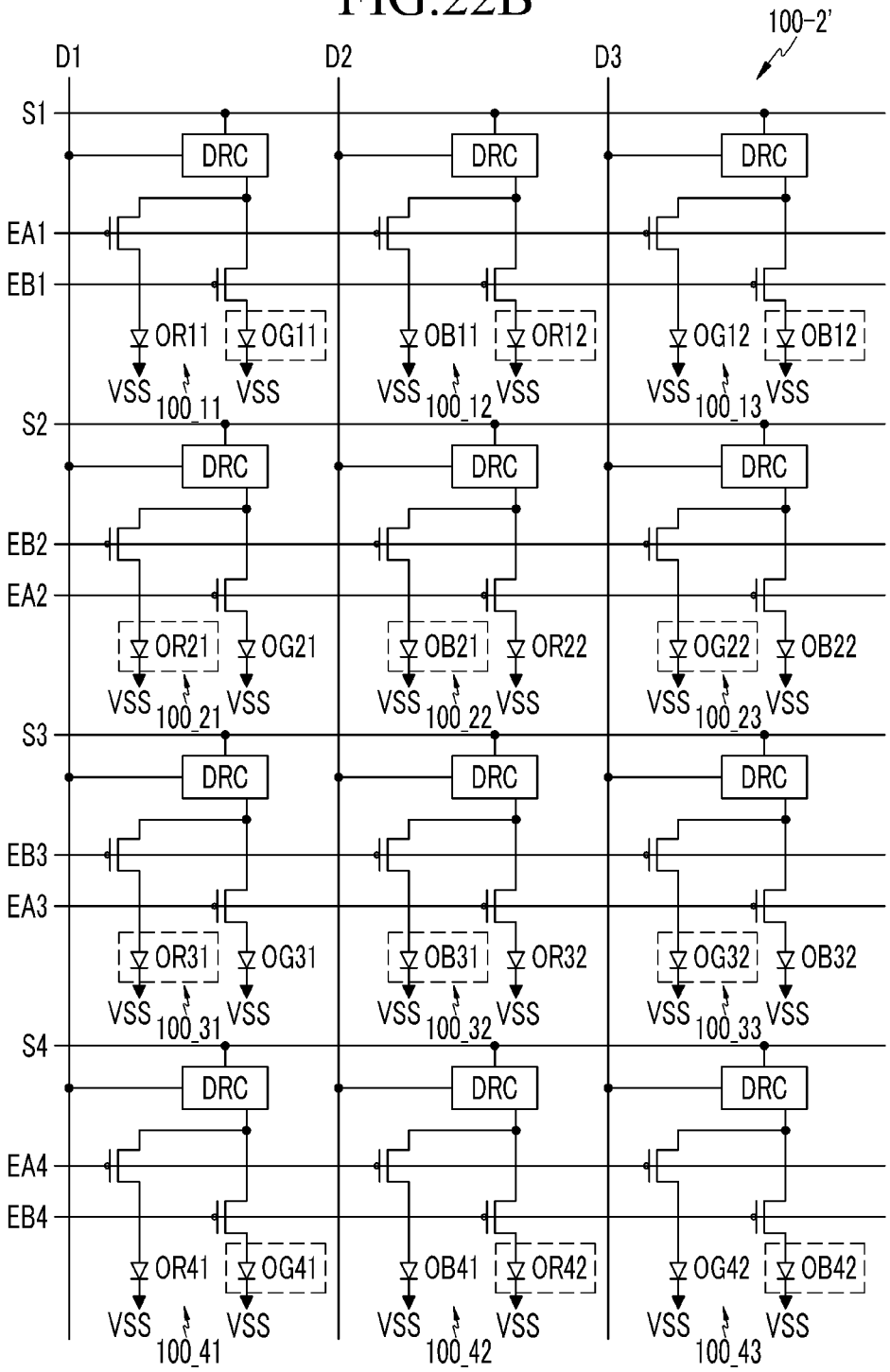

FIG. 22A and FIG. 22B are views schematically showing the driving of a pixel for respective fields in accordance with the data alignments of FIG. 21A and FIG. 21B.

The circuit structure of FIG. 22A and FIG. 22B is identical to that of the above-explained FIG. 18A and FIG. 18B, except that a connection pattern of the first light emission control lines EA and second light emission control lines EB connected to the first to third pixels 100_11 to 100-13 and 100_41 to 100_43 included in the first and fourth pixel lines is opposite to a connection pattern of the first light emission control lines EA and second light emission control lines EB connected to the first to third pixels 100_21 to 100-23 and 100_31 to 100_33 included in the second and third pixel lines.

In the first to third pixels of the second and third pixel lines, the second light emission control lines EB2 and EB3 are connected to the gate electrode of the light emitting transistor to each of the first light emitting elements, and the first light emission control lines EA2 and EA3 are connected to the gate electrode of the light emitting transistor connected to each of the second light emitting elements.

Thus, in FIG. 22A, the first to third pixels of the second and third pixel lines in the first field emit light in G, R, and B. Then, in FIG. 22B, the first to third pixels of the second and third pixel lines emit light in R, B, and G as indicated by the dotted part.

Accordingly, the light emission pattern for each field of FIG. 22A and FIG. 22B is shown as indicated by the dotted line, and hence is different from the light emission pattern for each field of FIGS. 18A and 18B. The driving scheme of FIGS. 22A and 22B will be described with reference to the timing diagram of FIG. 19.

When the first scan signal S[1] is applied at a low level to the first scan line at time t1, first field data corresponding to the first field is applied from the data lines D1 to D3 respectively corresponding to the pixels included in the first pixel line.

In synchronization with the application of the first scan signal S[1] at a low level, the first light emission control signal EA[1] is applied at a low-level voltage to the first one of the first light emission control lines, and the second light emission control signal EA[1] is applied a high-level voltage, having a phase opposite to that of the low-level voltage, to the first one of the second light emission control lines.

Accordingly, in response to the first light emission control signal EA[1], the first light emitting transistor is turned on, and a driving current corresponding to the first field data voltage is transmitted to the first light emitting elements through the first light emitting transistor, thereby achieving the light emission of the elements on one side (first light emitting elements) of the first to third pixels of the first pixel line. Accordingly, light is emitted in the order of RBG colors in the pixel line direction as indicated by the dotted line of FIG. 22A.

At this point, the second light emitting transistor connected to the elements on the other side (second light emitting elements) of the first to third pixels of the first pixel line is turned off by the second light emission control signal EB[1] applied at the high-level voltage, and the second light emitting elements of the first pixel line do not emit light.

In the second field, the first scan signal S[1] is applied again at a low level to the first scan line at time t6. In synchronization with the application of the first scan signal S[1], the voltage phases of the first light emission control signal EA[1] and second light emission control signal EB[1] transmitted to the first ones of the first and second light emission control lines are inverted.

Accordingly, in response to the second light emission control signal EB[1] applied at the low-level voltage, the first light emitting transistor connected to the elements on one side (second light emitting elements) of the first to third pixels of the first pixel line is turned on. The second light emitting elements of the first pixel line emit light of GRB colors in the pixel line direction.

At this point, the first light emitting transistor connected to the first light emitting element of each of the first to third pixels of the first pixel line is turned off by the first light emission control signal EA[1] with high-level voltage, and therefore the first light emitting elements of the first pixel line do not emit light.

Hereinafter, the remaining pixel lines are driven in the same manner. That is, in synchronization with scan signals sequentially applied for each pixel line, the first and second light emission control signals are sequentially applied at a low-level voltage and a high-level voltage, respectively, in the first field 1SF, and the first and second light emission control signals are sequentially applied at the high-level voltage and the low-level voltage, respectively, in the second field 2SF. As a result, the dotted part of FIG. 22A emits light in the first field, and the dotted part of FIG. 22B emits light in the second field 2SF.

Figure 23A:
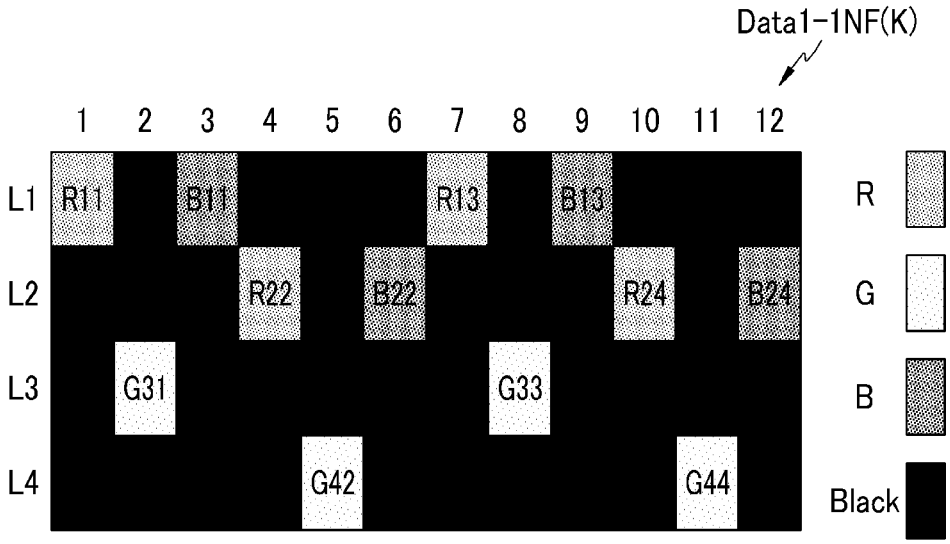
FIG. 23A and FIG. 23B are views showing the fields in which a 1-dot pattern is displayed according to the data arrangement of FIGS. 21A and 21B.
Figure 23B:
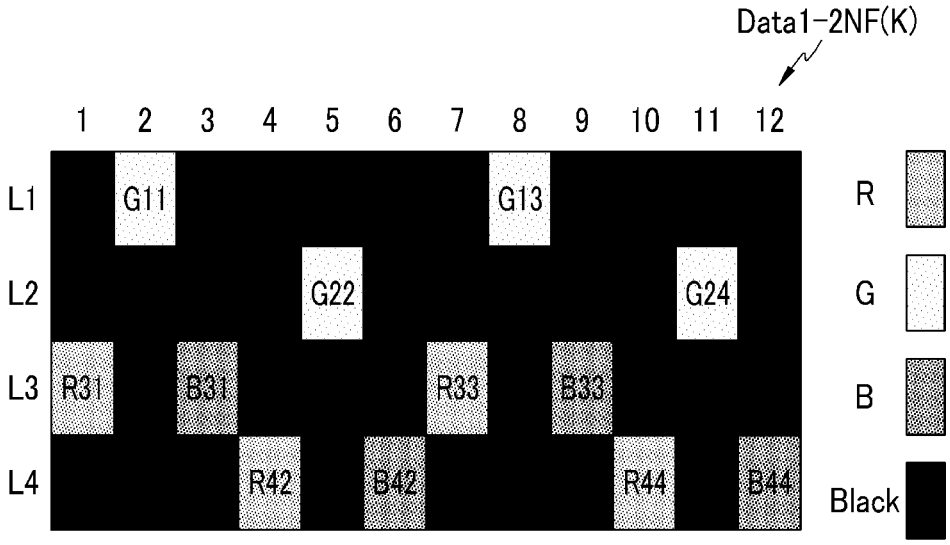

FIG. 23A and FIG. 23B are views showing the fields in which a 1-dot pattern is displayed according to the data arrangement of FIGS. 21A and 21B.

In the 1-dot pattern, the second and fourth dot areas of the first and third pixel lines L1 and L3 and the first and third dot areas of the second and fourth pixel lines L2 and L4 display a black image.

Accordingly, out of the first field output data Data1-1(NF) of FIG. 21A arranged in the third alignment method, G12 data and G14 data in the first pixel line L1 are black data in accordance with the 1-dot pattern, and light is emitted in accordance with R11, B11, R13, and B13 data.

In the second pixel line L2, G21 data and G23 data are black data, and light is emitted in accordance with R22 and B22 data and R24 and B24 data.

In the third pixel line L3, R32 and B32 data and R34 and B34 data are black data, and light is emitted in accordance with G31 data and G33 data.

In the fourth pixel line L4, R41 and B41 data and R42 and B42 data are black data, and light is emitted in accordance with G42 data and G44 data.

As a result, as shown in FIG. 23A, red light and blue light are emitted in the first and second pixel lines, and green light is emitted in the third and fourth pixel lines, thus displaying a first field image Data1-1NF(K) of the 1-dot pattern.

Meanwhile, out of the first field output data Data1-2(NF) of FIG. 21B arranged in the third alignment method, R12, B12, R24, and G14 data in the first pixel line L1 is black data in accordance with the 1-dot pattern, and light is emitted in accordance with G11 data and G13 data.

In the second pixel line L2, R21 and B21 data and R23 and B23 data are black data, and light is emitted in accordance with G22 data and G24 data.

In the third pixel line L3, G32 data and G34 data are black data, and light is emitted in accordance with R31 and B31 data and R33 and B33 data.

In the fourth pixel line L4, G41 data and G43 data are black data, and light is emitted in accordance with R42 and B42 data and R44 and B44 data.

As a result, as shown in FIG. 23B, green light is emitted in the first and second pixel lines, and red light and blue light are emitted in the third and fourth pixel lines, thus displaying a second field image Data1-2NF(K) of the 1-dot pattern.

Accordingly, as can be seen from FIGS. 23A and 23B, if the 1-dot pattern, which is a disruptive pattern, is displayed in accordance with data for each field re-arranged according to the third alignment method, this prevents picture distortion in each field, and especially red light emission is distributed over each field, thereby preventing color separation.

According to some embodiments, a display device including a display panel for displaying an image in at least two separate fields during a frame, a panel driver for transmitting output data for each field corresponding to the at least two fields and driving the display panel according to each field, and a controller that analyzes an image pattern of externally input data, and generates the output data for each field from the input data according to an analysis result of the pattern, or extracts each field data from the input data according to a predetermined data alignment method and generates the output data for each field by using the field data.

The controller includes a data determiner that analyzes the image pattern of the input data and outputs an analysis result of the pattern, a data aligner that, if the pattern is a normal pattern, generates the output data for each field from the input data, and if the pattern is an abnormal pattern, extracts and aligns data for each field from the input data in accordance with the predetermined data alignment method and generates the output data for each field by using the data for each field, and a signal generator that generates and transmits a plurality of control signals for controlling the operation of the panel driver.

The controller may further include a memory that stores the input data line by line or frame by frame depending on the analysis method of the image pattern.

Another embodiment provides a driving method of a display device, in which a frame is driven in a first field and a second field, output data is generated from externally input data to be transmitted to the display panel in the first field and the second field, respectively, and an image is displayed for each field, the method including: analyzing an image pattern of the input data and generating an analysis result of the pattern, if the pattern is a normal pattern, generating output data for each field from the input data to be transmitted to the first field and the second field, respectively, if the pattern is an abnormal pattern, extracting data for each field from the input data in accordance with a predetermined data alignment method and generating output data for each field to be transmitted to the first field and the second field, respectively, by using the data for each field.

According to some embodiments, a display device and a driving method of the same may be provided to realize a high-quality image by eliminating picture distortion in a display device according to time division driving method.

Particularly, a display device having a data arrangement and processing system and a data driving system may be provided to prevent picture distortion, such as pseudo contour and color separation, which may occur in time division driving if data input into the display device is a disruptive pattern.

Although some embodiments have been shown and described, it would be appreciated by those skilled in the art that changes and modifications might be made in these embodiments without departing from the principles and spirit of the invention, the scope of which is defined in the claims and their equivalents. Furthermore, the materials of each component described in the specification can easily be selected and substituted from various materials known to those skilled in the art. Those skilled in the art can omit a part of the components described herein without degrading the performance or can add components to improve the performance. Furthermore, those skilled in the art can change a sequence of the process steps described herein according to the process environment or the process apparatus. Therefore, the scope of the present invention should be defined by the claims and their equivalents rather than the foregoing embodiments.

What is claimed is:

1. A display device comprising:

a display panel configured to display an image in at least two separate fields during a frame;

a panel driver configured to transmit output data for each field corresponding to the at least two fields to the display panel and drive the display panel according to each field; and a controller configured to:

receive input data, and analyze an image pattern corresponding to the input data to generate output data for each field based on the input data, according to the analysis result, or generate the output data for each field by using data for each field extracted from the input data according to a predetermined data alignment;

wherein the controller comprises a data determiner configured to analyze the image pattern of the input data and output the analysis result, the data determiner comprising:

a first counter configured to sequentially read input data of a plurality of odd or even lines and count unit patterns a first comparator configured to compare the count of the first counter with a first threshold value, and if the count is greater than or equal to the first threshold value, the first comparator is configured to set a first flag bit in accordance with first input data of the corresponding line;

a second counter configured to sequentially read input data of a plurality of even or odd lines and count unit patterns;

a second comparator that compares the count of the second counter with the first threshold value, and if the count is greater than or equal to the first threshold value, the first comparator is configured to set a second flag bit in accordance with first input data of the corresponding line;

a pattern determiner configured to count comparison results between the first flag bit and the second flag bit alternately and consecutively transmitted from the first comparator and the second comparator, and if the count is greater than or equal to a second threshold value, the pattern determiner is configured to determine that the pattern is an abnormal pattern.

2. The display device of claim 1, wherein the analysis result includes information indicating whether the pattern is a normal pattern or an abnormal pattern causing picture distortion during time division driving.

3. The display device of claim 2, wherein the abnormal pattern corresponds to a 1-dot pattern which is displayed by a white image and a black image alternating in a first direction and a second direction perpendicular to the first direction.

4. The display device of claim 1, wherein the controller comprises:

a data aligner configured to, if the pattern is a normal pattern, generate the output data for each field from the input data, and if the pattern is an abnormal pattern, extract and align data for each field from the input data in accordance with the predetermined data alignment method and generate the output data for each field by using the aligned data for each field; and a signal generator configured to generate and transmit a plurality of control signals for controlling the operation of the panel driver.

5. The display device of claim 4, wherein the controller further comprises a memory configured to store the input data line by line or frame by frame depending on the analysis method of the image pattern.

6. The display device of claim 1, wherein the data determiner further comprises:

a detector configured to read the input data line by line from the memory and generate detection bit data in response to a detection result of color information;

a first line memory configured to write detection bit data in the corresponding address, the detection bit data corresponding to input data of a plurality of odd or even lines among the input data;

a second line memory configured to write detection bit data in the corresponding address, the detection bit data corresponding to input data of a plurality of even or odd lines among the input data;

a first bit counter configured to sequentially read the detection bit data stored in the first line memory line by line and count unit patterns;

a second bit counter configured to sequentially read the detection bit data stored in the second line memory line by line and count unit patterns;

a first bit comparator configured to compare the count of the first bit counter with a third threshold value, and if the count is greater than or equal to the third threshold value, the first bit comparator is configured to set a third flag bit in accordance with the first input data of the corresponding line;

a second bit comparator configured to compare the count of the second bit counter with the third threshold value, and if the count is greater than or equal to the third threshold value, the second bit comparator is configured to set a fourth flag bit in accordance with the first input data of the corresponding line;

a line comparator configured to compare the third flag bit and the fourth flag bit which are alternately and consecutively transmitted from the first bit comparator and the second bit comparator;

a line counter configured to count a comparison result indicating that the third flag bit and the fourth flag bit are equal to a specific bit for a unit pattern; and a pattern determiner configured to, if the count of the line counter is greater than or equal to the second threshold value, the pattern determiner is configured to determine the pattern to be an abnormal pattern.

7. The display device of claim 4, wherein the data aligner is configured to align first field data and second field data alternately extracted for each single color data from the input data by dividing each of the first field data and the second field data line by line and add black data between two neighboring field data among a plurality of field data for each line.

8. The display device of claim 4, wherein the data aligner is configured to align first field data and second field data alternately extracted for each single color data from the input data.

9. The display device of claim 7, wherein, among each of the aligned first field data and second field data, a plurality of field data disposed in the same column have the same color information.

10. The display device of claim 9, wherein the color information of the plurality of field data is an array of first, second, and third colors are repeated in the direction of the same column.

11. The display device of claim 4, wherein the data aligner is configured to align first field data and second field data alternately extracted for each single color data from the input data, wherein color information of a plurality of field data corresponding to an area defined by consecutive 4 lines and consecutive 3 columns is aligned such that the same columns in the first and fourth lines have the same color and the same columns in the second and third lines have the same color.

12. The display device of claim 1, wherein the frame comprises a first field and a second filed, the display panel comprises a plurality of first pixels emitting light in the first field and a plurality of second pixels emitting light in the second field, and the panel driver comprises a data driver configured to transmit the first field output data to the plurality of first pixels in the first field and transmits second field data to the plurality of second pixels in the second field.

13. The display device of claim 12, wherein the first field output data comprises first color data, second color data, and third color data which are repeatedly and sequentially applied as the same color data to the first pixels included in the odd pixel columns, and black data which is applied to the second pixels included in the even pixel columns, and the second field output data comprises first color data, second color data, and third color data which are repeatedly and sequentially applied as the same color data to the second pixels included in the even pixel columns and black data which is applied to the first pixels included in the odd pixel columns.

14. The display device of claim 12, wherein, if input data has a 1-dot pattern in which a white image and a black image are alternately displayed in first and second directions perpendicular to each other, the ratio of colors in an image displayed by the first field output data and the ratio of colors in an image displayed by the second field output data are equal.

15. The display device of claim 1, wherein the frame comprise a first field and a second field, and the display panel comprises a plurality of pixels each comprising a first light emitting element for emitting light in the first field and a second light emitting element for emitting light in the second field, and the panel driver comprises:

a data driver configured to transmit the first field output data to the display panel in the first field and transmit the second field output data to the display panel in the second field; and a light emission driver configured to generate and supply a first light emission control signal for controlling the light emission of the first light emitting element in the first field and a second light emission signal for controlling the light emission of the second light emitting element in the second field.

16. The display device of claim 15, wherein the first field output data is transmitted to the respective first light emitting elements included in three pixels consecutive in a direction so that at least three color data for emitting light in different colors are repeatedly aligned, and the second field output data is transmitted to the respective second light emitting elements included in three pixels consecutive in the same direction so that at least three color data for emitting light in different colors are repeatedly aligned.

17. The display device of claim 15, wherein the first field output data repeatedly comprises a first unit area, and the second field output data repeatedly comprises a second unit area, wherein the first unit area comprises first color data, third color data, and second color data which are transmitted to respective elements on one side of three consecutive pixels included in the first pixel line and the fourth pixel line and comprises second color data, first color data, and third color data which are transmitted to respective elements on the other side of three consecutive pixels included in the second pixel line and the third pixel line, and wherein the second unit area comprises second color data, first color data, and third color data which are transmitted to the respective elements on the other side of three consecutive pixels included in the first pixel line and the fourth pixel line and comprises first color data, third color data, and second color data which are transmitted to the respective elements on one side of three consecutive pixels included in the second pixel line and the third pixel line.

18. The display device of claim 15, wherein the voltage phases of the first light emission control signal and the second light emission control signal are opposite, and the voltage phases of the first light emission control signal and the second light emission control signal alternate in the first and second fields.

19. The display device of claim 15, wherein, if input data has a 1-dot pattern in which a white image and a black image are alternately displayed in first and second directions perpendicular to each other, the ratio of colors in an image displayed by the first field output data and the ratio of colors in an image displayed by the second filed output data are equal.

20. The display device of claim 19, wherein the ratio of colors is the distribution ratio of color data having the highest luminance in the first field and the second field respectively.

21. A method for driving a display device, in which a frame is driven in a first field and a second field based on input data to be transmitted to the display panel in the first field and the second field, respectively, and an image is displayed for each field, the method comprising:

sequentially reading the input data line by line and counting a unit pattern for each line;

if the cumulative count of unit patterns for each line is greater than a first reference value, setting flag bits in accordance with the first input data of each line;

determining if the unit pattern is a normal pattern or an abnormal pattern based on an analysis result;

if the unit pattern is a normal pattern, generating output data for each field from the input data to be transmitted to the first field and the second field, respectively; and if the pattern is an abnormal pattern, extracting data for each field from the input data in accordance with a predetermined data alignment method and generating output data for each field to be transmitted to the first field and the second field, respectively, by using the data for each field.

22. The method of claim 21, wherein the abnormal pattern is an image pattern that results in picture distortion during time division driving, and wherein the abnormal pattern comprises a 1-dot pattern in which a white image and a black image are alternately displayed in first and second direction perpendicular to each other.

23. The method of claim 21, wherein the unit pattern comprises consecutive white data and black data, or consecutive black data and white data, and the cumulative count is incremented by 1 each time the flag bits of the two neighboring lines are different.

24. The method of claim 21, wherein analyzing the image pattern comprises:

sequentially reading the input data line by line and generating detection bit data in response to a detection result of color information;

writing detection bit data in accordance with input data of a plurality of odd or even lines in the corresponding addresses of line memories;

sequentially reading the detection bit data stored in the respective line memories line by line and counting unit patterns;

if the cumulative count of unit patterns for each line is greater than a third reference value, setting flag bits in accordance with the first input data of each line; and if the cumulative count of comparison results between two flag bits of neighboring lines among the flag bits set for each line is greater than a fourth reference value, the pattern is determined to be an abnormal pattern.

25. The method of claim 21, wherein if the image pattern is an abnormal pattern, the method comprises aligning first field data and second field data alternately extracted for each single color data from the input data by dividing the first field data and the second field data each line by line and adding black data between two neighboring field data among a plurality of field data for each line.

26. The method of claim 21, wherein the data alignment method of the third step involving aligning first field data and second field data alternately extracted for each single color data from the input data.

27. The method of claim 25 or claim 26, wherein, among each of the aligned first field data and second field data, a plurality of field data disposed in the same column have the same color information.

28. The method of claim 21, wherein, if the image pattern is an abnormal pattern, the method comprises aligning first field data and second field data alternately extracted for each single color data from the input data, wherein color information of a plurality of field data corresponding to an area defined by consecutive 4 lines and consecutive 3 columns is aligned such that the same columns in the first and fourth lines have the same color and the same columns in the second and third lines have the same color.

29. The method of claim 21, wherein, if the pattern is a 1-dot pattern in which a white image and a black image are alternately displayed in first and second directions perpendicular to each other, the distribution ratio of colors in an image displayed by the first field output data and the distribution ratio of colors in an image displayed by the second filed output data are equal.

* * * * *